US010851789B2

(12) United States Patent
Choi et al.

(10) Patent No.: US 10,851,789 B2
(45) Date of Patent: Dec. 1, 2020

(54) COMPRESSOR HAVING IMPROVED DISCHARGE STRUCTURE INCLUDING DISCHARGE INLETS, COMMUNICATION HOLE, AND DISCHARGE OUTLET

(71) Applicant: LG ELECTRONICS INC., Seoul (KR)

(72) Inventors: Yong Kyu Choi, Seoul (KR); Cheol Hwan Kim, Seoul (KR); Howon Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 429 days.

(21) Appl. No.: 15/830,248

(22) Filed: Dec. 4, 2017

(65) Prior Publication Data

US 2019/0010945 A1 Jan. 10, 2019

(30) Foreign Application Priority Data

Jul. 10, 2017 (KR) ..... 10-2017-0087365

(51) Int. Cl.
*F04C 29/12* (2006.01)
*F04C 18/02* (2006.01)
*F04C 23/00* (2006.01)

(52) U.S. Cl.
CPC ..... *F04C 29/12* (2013.01); *F04C 18/0215* (2013.01); *F04C 18/0261* (2013.01); (Continued)

(58) Field of Classification Search
CPC ..... F04C 18/0215; F04C 18/0261; F04C 2240/30; F04C 2240/50; F04C 2240/60; (Continued)

(56) References Cited

U.S. PATENT DOCUMENTS 4,596,520 A 6/1986 Arata et al.
4,626,180 A 12/1986 Tagawa
(Continued)

FOREIGN PATENT DOCUMENTS

EP 1 526 283 4/2005
EP 2 369 182 9/2011
(Continued)

OTHER PUBLICATIONS

English Translation of JPH10169574A, translated from Espacenet on Feb. 20, 2020. (Year: 2020).*
(Continued)

*Primary Examiner* — Patrick Hamo
*Assistant Examiner* — Paul W Thiede
(74) *Attorney, Agent, or Firm* — KED & Associates LLP

(57) ABSTRACT

A scroll compressor is provided, that may include a connection groove to reduce discharge resistance. The scroll compressor may include a fixed scroll including a fixed end plate and a feed wrap and an orbiting scroll, rotating with respect to the fixed scroll and including an orbiting end plate and an orbiting wrap, and structure in which a connection groove having a concave groove shape provided at an inner surface of the fixed end plate to allow a refrigerant to flow through the connection groove depending on an overlapping state of the fixed wrap and the connection groove, thereby providing an effect of increasing opening efficiency of discharge holes at a beginning of discharge.

6 Claims, 26 Drawing Sheets

(52) U.S. Cl.
CPC ..... *F04C 23/008* (2013.01); *F04C 2240/30* (2013.01); *F04C 2240/50* (2013.01); *F04C 2240/60* (2013.01); *F04C 2250/102* (2013.01)

(58) Field of Classification Search
CPC .. F04C 2250/102; F04C 23/008; F04C 29/12; F04C 18/0246; F04C 18/0253; F04C 29/0057; F04C 29/023; F04C 29/025; F04C 18/0292; F04C 27/005; F04C 2210/26; F04C 2240/0603
USPC ... 418/55.1, 55.2, 55.3, 55.4, 55.5, 55.6, 57, 418/88, 94; 184/6.16–6.18
See application file for complete search history.

(56) References Cited

U.S. PATENT DOCUMENTS

| | | | | |
|---|---|---|---|---|
| 4,768,936 | A | 9/1988 | Etemad | |
| 4,898,521 | A | 2/1990 | Sakurai | |
| 5,803,722 | A | 9/1998 | Noboru | |
| 6,273,691 | B1 | 8/2001 | Morimoto et al. | |
| 2009/0098000 | A1 | 4/2009 | Ignatiev | |
| 2010/0122549 | A1 | 5/2010 | Cho | |
| 2012/0148434 | A1 | 6/2012 | Takabe et al. | |
| 2013/0078131 | A1 | 3/2013 | Ahn et al. | |
| 2013/0343941 | A1 | 12/2013 | Kim et al. | |
| 2014/0234148 | A1 | 8/2014 | Takeda | |
| 2016/0040671 | A1 | 2/2016 | Choi et al. | |
| 2016/0040673 | A1 | 2/2016 | Lee et al. | |
| 2016/0047378 | A1* | 2/2016 | Choi ..... | F04C 29/12 418/55.1 |
| 2016/0053759 | A1 | 2/2016 | Choi et al. | |
| 2016/0108917 | A1 | 4/2016 | Bonnefoi | |
| 2016/0341249 | A1 | 11/2016 | Yang | |

FOREIGN PATENT DOCUMENTS

| | | |
|---|---|---|
| EP | 2 574 791 | 4/2013 |
| EP | 2 690 287 | 1/2014 |
| JP | S62-178791 | 8/1987 |
| JP | H03-202682 | 9/1991 |
| JP | H 07-054784 | 2/1995 |
| JP | H08-303364 | 11/1996 |
| JP | H 08-303365 | 11/1996 |
| JP | H 10-169574 | 6/1998 |
| JP | 2009-036069 | 2/2009 |
| JP | 2010-180704 | 8/2010 |
| JP | 5 199951 | 5/2013 |
| KR | 10-105880 | 8/2011 |
| KR | 10-2013-0034536 | 4/2013 |
| KR | 10-2016-0017539 | 2/2016 |
| WO | WO 97/17543 | 5/1997 |
| WO | WO 2014/198215 | 12/2014 |
| WO | WO 2015/085823 | 6/2015 |

OTHER PUBLICATIONS

U.S. Office Action dated Nov. 14, 2019 issued in U.S. Appl. No. 15/830,290.
United States Office Action dated Jan. 14, 2020 issued in co-pending related U.S. Appl. No. 15/830,135.
European Search Report dated Apr. 26, 2018 issued in Application No. 17199214.2.
U.S. Appl. No. 15/830,135, filed Dec. 4, 2017, Phutthiwat Wongwian.
U.S. Appl. No. 15/830,161, filed Dec. 4, 2017, Phutthiwat Wongwian.
U.S. Appl. No. 15/830,184, filed Dec. 4, 2017, Phutthiwat Wongwian.
U.S. Appl. No. 15/830,222, filed Dec. 4, 2017, Phutthiwat Wongwian.
U.S. Appl. No. 15/830,290, filed Dec. 4, 2017, Phutthiwat Wongwian.
Korean Office Action dated Aug. 20, 2018.
European Search Report dated Sep. 7, 2018.
United States Office Action dated Oct. 31, 2019 issued in co-pending related U.S. Appl. No. 15/830,161.
European Search Report dated May 4, 2018 issued in Application No. 17204354.9.
European Search Report dated May 17, 2018 issued in Application No. 17205582.4.
Korean Office Action dated Jul. 16, 2018 issued in Application No. 10-2017-0075041.
European Office Action dated Feb. 6, 2020.
U.S. Notice of Allowance dated in Application No. 15/830,222 dated Jun. 18, 2020.
U.S. Office Action dated Apr. 30, 2020 issued in U.S. Appl. No. 15/830,290.
U.S. Appl. No. 15/830,135, filed Dec. 4, 2017.
U.S. Appl. No. 16/692,112, filed Nov. 22, 2019.
U.S. Appl. No. 15/830,161, filed Dec. 4, 2017.
U.S. Appl. No. 15/830,184, filed Dec. 4, 2017.
U.S. Appl. No. 15/830,222, filed Dec. 4, 2017.
U.S. Appl. No. 16/692,088, filed Nov. 22, 2019.
U.S. Appl. No. 15/830,290, filed Dec. 4, 2017.
U.S. Office Action dated Jan. 28, 2020 issued in co-pending related U.S. Appl. No. 15/830,222.

* cited by examiner

DISCHARGE START TIME

DISCHARGE START TIME + 10°

DISCHARGE START TIME + 20°

DISCHARGE START TIME + 30°

DISCHARGE START TIME + 40°

COMPRESSOR HAVING IMPROVED DISCHARGE STRUCTURE INCLUDING DISCHARGE INLETS, COMMUNICATION HOLE, AND DISCHARGE OUTLET

CROSS-REFERENCE TO RELATED APPLICATION(S)

This application claims priority to and the benefit of Korean Patent Application No. 10-2017-087365, filed in Korea on Jul. 10, 2017, the disclosure of which is incorporated herein by reference in its entirety.

BACKGROUND

1. Field

A scroll compressor, and more particularly, to a scroll compressor having an improved discharge structure through which a refrigerant compressed in a compression chamber is discharged are disclosed herein.

2. Background

Generally, a compressor is an apparatus that converts mechanical energy into compression energy of a compressive fluid. Such compressors may be classified into a reciprocating type compressor, a rotary type compressor, a vane type compressor, and a scroll type compressor depending on a fluid compression method.

A scroll compressor includes a fixed scroll including a fixed wrap and an orbiting scroll including an orbiting wrap engaged with the fixed wrap. That is, the scroll compressor is a compressor in which the orbiting scroll performs an orbiting movement along the fixed scroll and suctions and compresses a refrigerant through consecutive changes in volume of a compression chamber formed between the fixed wrap and the orbiting wrap.

Scroll compressors are generally used for compressing a refrigerant in an air conditioning apparatus due to advantages of obtaining a relatively high compression ratio in comparison to other compressors and obtaining stable torque by smoothly performing suction, compression, and discharge operations of a refrigerant. In the scroll compressor, operational properties thereof are determined depending on shapes of the fixed wrap and the orbiting wrap. The feed wrap and the orbiting wrap may have random shapes, but generally have easily processable involute curve shapes.

The orbiting scroll generally includes a circular end plate and the orbiting wrap formed on one side of the end plate. A boss having a certain height is formed on the other side of the end plate on which the orbiting wrap is not formed. An eccentric portion of a rotary shaft is coupled to the boss to cause the orbiting scroll to orbit. As this structure may have the orbiting wrap throughout approximately an entire area thereof, when a compression ratio to be obtained is the same, there is an advantage of forming a small-sized end plate.

However, in this structure, as the orbiting wrap and the boss are spaced apart in an axial direction, an acting point at which a repulsive force of a refrigerant acts when the refrigerant is compressed and an acting point at which a reaction force for compensating the repulsive force acts are at different positions in the axial direction. Due thereto, as the repulsive force and the reaction force act as a pair of opposing forces and tilt the orbiting scroll when the compressor operates, there is a disadvantage in that vibration or noise increases when the compressor operates.

To overcome the above-described limitations, Korean Patent Registration No. 10-1059880, which is hereby incorporated by reference, discloses a scroll compressor having a form in which a point at which an eccentric portion of a rotary shaft is coupled to an orbiting scroll is flush with a scroll wrap (a position overlapping the rotary shaft). As an acting point at which a repulsive force of a refrigerant acts and an acting point of a reaction force against the repulsive force are at the same height in opposite directions in the scroll compressor, which has a structure in which the eccentric portion of the rotary shaft is coupled to the orbiting wrap at a height overlapping the rotary shaft, it is possible to overcome a limitation in which the orbiting scroll is tilted.

The scroll compressor includes a discharge hole through which a refrigerant compressed in each compression chamber is discharged. The compression chambers include a first compression chamber formed on an outer surface of the orbiting wrap and a second compression chamber formed on an inner surface of the orbiting wrap.

The second compression chamber has a limitation in providing an opening area of a discharge inlet during initial discharge. Also, the first compression chamber and the second compression chamber generally individually include discharge holes and discharge valves for the discharge holes. However, there is a limitation in which a hitting noise occurs when the discharge valve is opened and closed.

BRIEF DESCRIPTION OF THE DRAWINGS

Embodiments will be described in detail with reference to the following drawings in which like reference numerals refer to like elements, and wherein;

FIG. 9 is an enlarged plan view illustrating a center in FIG. 8;

DETAILED DESCRIPTION

The terms used in the specification and the claims are not be limited to general or lexical meanings and should be understood as having meanings and concepts appropriate for the technical concept based on the principle in which the meanings of the terms can be adequately defined by the inventor to describe embodiments in the best way. Also, as components described and shown in the embodiments and drawings disclosed in the specification are merely one of exemplary embodiments and do not represent the whole technical concept, it should be understood that various equivalents and modifications capable of replacing the components may be present at the filing time of the present application.

Hereinafter, a scroll compressor according to embodiments will be described with reference to the attached drawings.

Figure 1:
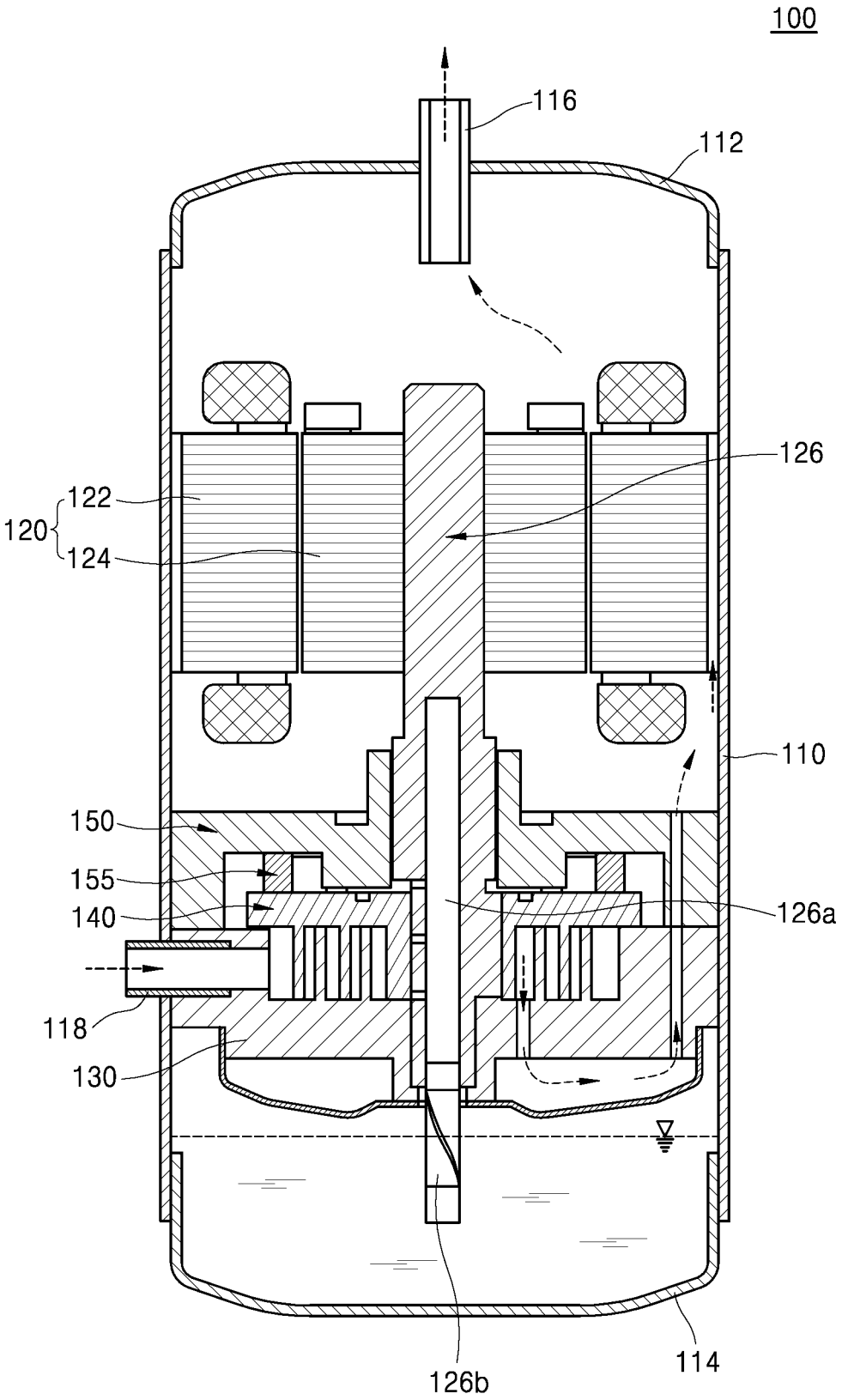
FIG. 1 is a schematic cross-sectional view of a scroll compressor according to an embodiment.
Figure 2:
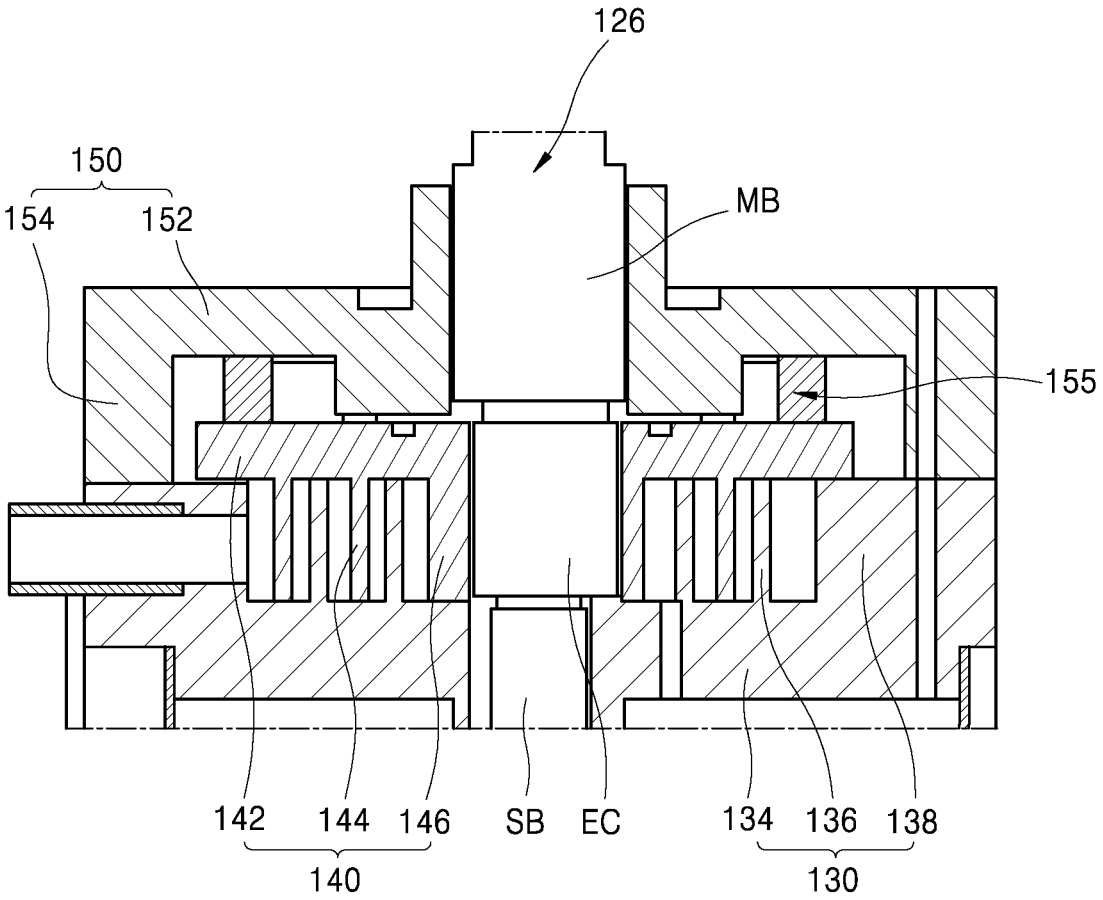
FIG. 2 is an enlarged cross-sectional view of a compression portion shown in FIG. 1.
Figure 3:
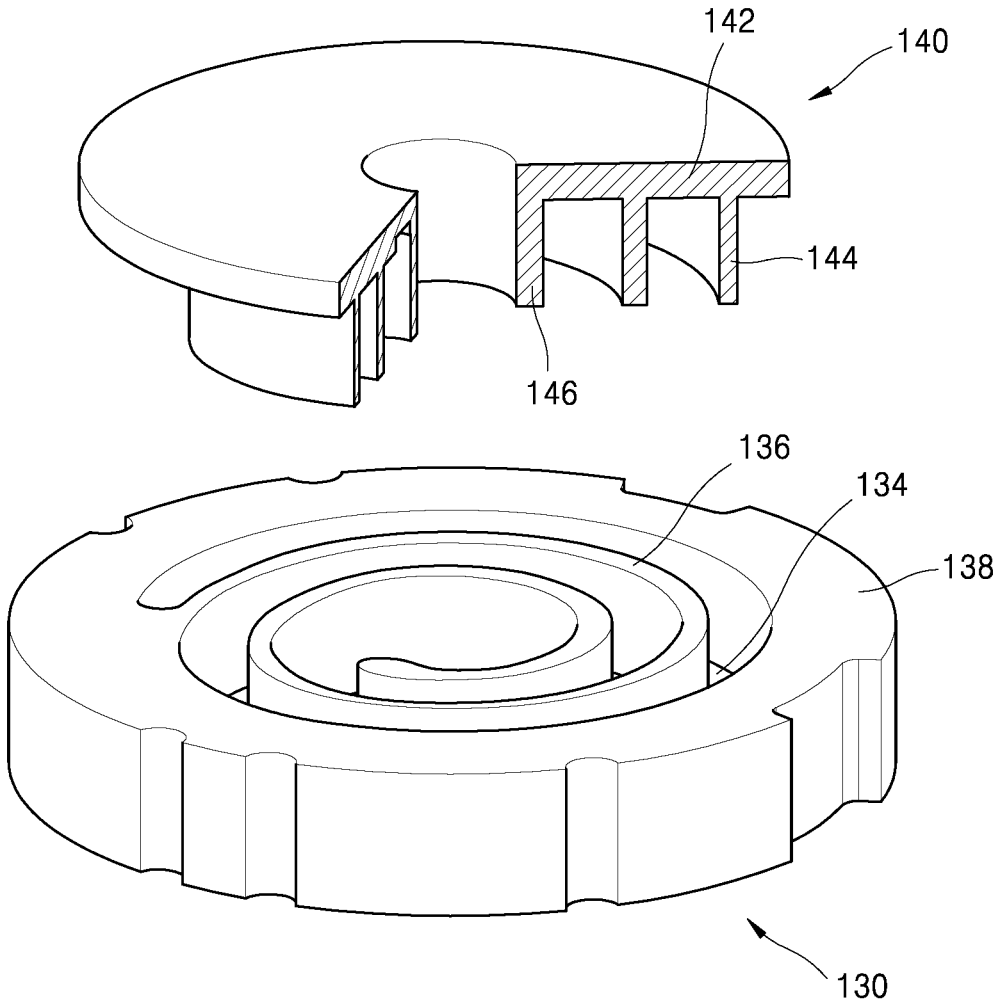
FIG. 3 is a separate perspective view illustrating the compression portion partially cut in FIG. 1.

FIG. 1 is a cross-sectional view illustrating internal structure of a scroll compressor 100 according to an embodiment. FIG. 2 is an enlarged cross-sectional view of a compression portion shown in FIG. 1. FIG. 3 is a separate perspective view illustrating the compression portion partially cut in FIG. 1.

Referring to FIGS. 1 to 3, the scroll compressor 100 according to an embodiment may include a cylindrical casing 110 and an upper shell 112 and a lower shell 114 which cover a top and a bottom of the casing 110, respectively. The upper shell 112 and the lower shell 114 may be welded, for example, to the casing 110 to form a single sealed space with the casing 110.

A discharge pipe 116 may be disposed or provide at the upper shell 112. The discharge pipe 118 may be a channel through which a compressed refrigerant may be discharged outward, and an oil separator (not shown) that separates an oil mixed with the discharged refrigerant may be connected to the discharge pipe 116.

A suction pipe 118 may be disposed or provided at a side of the casing 110. The suction pipe 118 may be a channel through which a refrigerant to be compressed flows into the scroll compressor 100.

The lower shell 114 may function as an oil chamber that stores an oil supplied to allow the compressor to smoothly operate.

A drive motor 120 may be installed or provided at a top in the casing 118. The drive motor 120 may include a stator 122 fixed to an inner surface of the casing 110 and a rotor 124 positioned in the stator 122 and rotated by an interaction with the stator 122. A refrigerant flow channel may be formed between an outer circumferential surface of the stator 122 and the inner surface of the casing 110.

A rotary shaft 126 may be coupled to a center of the rotor 124 such that the rotor 124 and the rotary shaft 126 are integrated and rotate with each other. An oil flow channel **126*a* may be provided at a center of the rotary shaft 126 to extend along a longitudinal or axial direction. An oil pump 126*b* that supplies the oil stored in the fewer shell 114 upward may be provided at a bottom end of the rotary shaft 126. Although not shown in the drawings, the oil pump 126*b*** may include a spiral groove, an additional impeller installed in the oil channel, or an additional volumetric pump.

Rotational power generated by the rotor 124 may be transferred to the compression portion through the rotary shaft 126. The compression portion may include a fixed scroll 130, an orbiting scroll 140, a main frame 150, and an Oldham ring 155.

The rotary shaft 126 may include a main bearing MB coupled to the main frame 150, a sub bearing SB coupled to the fixed scroll 130, and an eccentric portion EC coupled to the orbiting scroll 140.

The main frame 150 may be disposed below the drive motor 120 and form a top of the compression portion. The main frame 160 may be coupled to the fixed scroll 130, and the orbiting scroll 140 may be disposed between the main frame 150 and the fixed scroll 130 such that the orbiting scroll 140 may perform an orbiting movement.

The main frame 150 may include a frame end plate 152 and a frame sidewall 154. The frame end plate 152 may have an approximately circular shape, and the rotary shaft 126 may pass through a center thereof and be coupled therewith. The frame sidewall 154 may extend toward the fixed scroll 130 such that a bottom end thereof may be coupled to the fixed scroll 130.

The frame sidewall 154 may include a discharge hole that longitudinally passes through an inside thereof. The frame discharge hole provides a channel through which a compressed refrigerant may move.

The fixed scroll 130 may include a fixed end plate 134, a fixed scroll sidewall 138, and a fixed wrap 136. The fixed end plate 134 may have an approximately circular shape. The fixed scroll sidewall 138 may extend from an outer circumferential portion of the fixed end plate 134 toward the main frame 150 and be connected to the main frame 150.

The fixed wrap 138 may protrude above the fixed end plate 135. The fixed wrap 138 may be engaged with an orbiting wrap 144 of the orbiting scroll 140 to form a compression chamber.

The orbiting scroll 140 may include an orbiting end plate 142, the orbiting wrap 144, and a rotary shaft coupler 146. The orbiting end plate 142 may have an approximately circular shape and face the fixed end plate 134. The orbiting wrap 144 may protrude from a bottom surface of the orbiting end plate 142 toward the fixed end plate 134 and be engaged with the fixed wrap 138.

The rotary shaft coupler 146 may be disposed at a center of the orbiting end plate 142 and be rotatably coupled to the eccentric portion EC of the rotary shaft 128. The rotary shaft coupler 148 may have a height overlapping the orbiting wrap 144 and be connected to the orbiting wrap 144. An outer circumferential portion of the rotary shaft coupler 146 may be connected to the orbiting wrap 144 and form the compression chamber with the fixed wrap 136 during a compression process. The compression process will be described hereinafter.

During compression, a repulsive force of a refrigerant may be applied to the fixed wrap 138 and the orbiting wrap 144 and a compression force may be applied between a rotary shaft supporter and the eccentric portion EC as a reaction force. As described above, when a portion of the rotary shaft passes through the end plate and overlaps the wrap, and the repulsive force of the refrigerant and the compression force are applied to the same side relative to the end plate, the forces cancel each other out. Due to this, tilting of the orbiting scroll caused by effects of the compression force and the repulsive force may be prevented.

Also, although not shown in the drawings, a discharge hole may be formed at the fixed end plate 134 to allow a compressed refrigerant to be discharged into the casing 110. A position of the discharge bole may be arbitrarily determined in consideration of a necessary discharge pressure, for example.

The Oldham ring 155 for preventing rotation of the orbiting scroll 140 may be installed or provided above the orbiting scroll 140. The Oldham ring 155 may be installed or provided between the main frame 150 and the orbiting scroll 140. The Oldham ring 155 may be key-coupled to each of the main frame 150 and the orbiting scroll 140 to prevent rotation of the orbiting scroll 140.

A refrigerant suctioned through the suction pipe 118 may be compressed in the compression chamber formed by the fixed scroll 130 and the orbiting scroll 140 and then discharged. The refrigerant, discharged from the compression chamber may pass through the fixed scroll sidewall 138 and the frame sidewall 154 and move upward, pass the drive motor 120 and then be discharged through the discharge pipe 116.

Hereinafter, a case in which the fixed wrap 138 and the orbiting wrap 144 have involute shapes will be described for understanding of embodiments before shapes of the fixed scroll 130 and the orbiting scroll 140 are described.

Figure 4A:
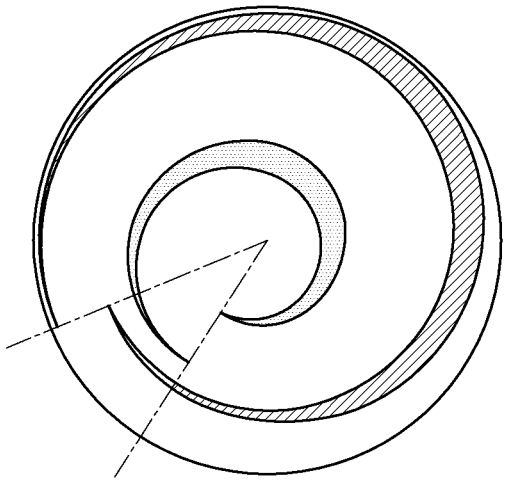
FIGS. 4A and 4B are plan views illustrating first and second compression chambers immediately after suction and immediately before discharge in a general scroll compressor including an involute orbiting wrap and an involute fixed wrap.
Figure 4B:
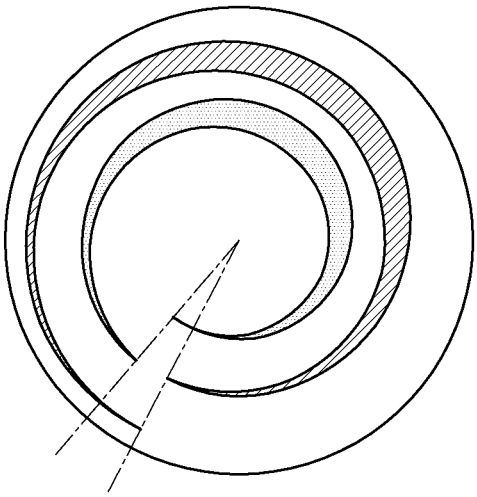

FIGS. 4A and 4B are plan views illustrating a compression chamber immediately after suction and a compression chamber immediately before discharge in a scroll compressor having a form in which an orbiting wrap and a fixed wrap are formed of involute curves and a portion of a rotary shaft passes through an end plate. FIG. 4A illustrates a change in a first compression chamber formed between an inner surface of the fixed wrap and an outer surface of the orbiting wrap, and FIG. 4B illustrates a change to a second compression chamber formed between an inner surface of the orbiting wrap and an outer surface of the fixed wrap.

In the scroll compressor, the compression chamber is formed between two contact points formed by contact between the fixed wrap and the orbiting wrap. When the fixed wrap and the orbiting wrap have involute curves, as shown in FIGS. 4A and 4B, the two contact points that define one compression chamber are aligned. In other words, the compression chamber extends 360° centered on the rotary shaft.

Referring to FIG. 4A, a volume of the first compression chamber is gradually reduced moving toward a central portion due to rotation of an orbiting scroll and has a minimum value when reaching an outer circumferential portion of a rotary shaft coupler positioned at a center of the orbiting scroll. When the fixed wrap and the orbiting wrap have involute curves, a volume reduction rate is linearly reduced as a rotation angle (hereinafter, referred to as "a crank angle") of the rotary shaft increases. Accordingly, to obtain, a high compression ratio, it is necessary to move the compression chamber as close to the center as possible. However, when the rotary shaft is present at the central portion, the compression chamber may be moved only to an outer circumferential portion of the rotary shaft. Due to this, the compression ratio is decreased.

Figure 5A:
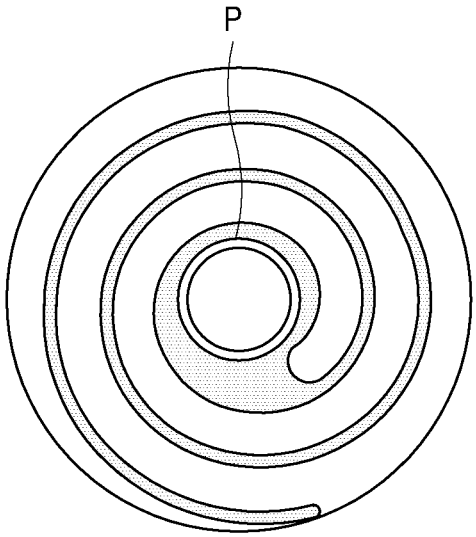
FIGS. 5A and 5B are plan views illustrating a shape of an orbiting wrap in another general scroll compressor including an involute orbiting wrap and an involute fixed wrap.
Figure 5B:
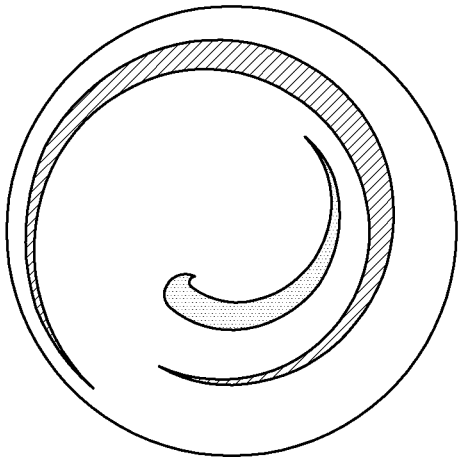

The second compression chamber shown in FIG. 4B has a lower compression ratio than a compression ratio of the first compression chamber. However, in the case of the second compression chamber, when a connection portion between a rotation shaft coupler P and the orbiting wrap is formed in a circular arc shape by changing a shape of the orbiting scroll, as shown in FIG. 5A, a compression channel of the second compression chamber is lengthened to increase the compression ratio before discharge. In this case, the second compression chamber has a range of less than about 360° immediately before discharge. However, it is impossible to apply the above-described method to the first compression chamber.

Accordingly, when the fixed wrap and the orbiting wrap have involute-shapes, the second compression chamber may obtain a desirable compression ratio but the first compression chamber cannot. When a notable difference is present between the compression ratios of the two compression chambers, operation of the compressor is detrimentally affected and a total compression ratio is decreased.

To overcome this, in the embodiment, the fixed, wrap and the orbiting wrap have different curves instead of involute curves. FIGS. 6A to 6E illustrate a process of determining shapes of the fixed wrap and the orbiting wrap in the embodiment, and a solid line is an envelope for the first compression chamber and a dotted line is an envelope for the second compression chamber.

The term "envelope" refers to a path formed by a movement of a certain shape. The solid line shows a path formed in a suction and discharge process of the first compression chamber, and the dotted line shows a path in the second compression chamber.

Accordingly, in a case of a parallel movement to both sides by as much as an orbital radius of the orbiting scroll based on the solid line, shapes of the inner surface of the fixed wrap and the outer surface of the orbiting wrap are formed, in the case of a parallel movement based on the dotted line, shapes of the outer surface of the fixed wrap and the inner surface of the orbiting wrap are formed.

FIG. 5A illustrates an envelope corresponding to a case of having a wrap shape shown in FIG. 5A. A portion shown with a thick line corresponds to the first compression chamber immediately before discharge, and a start point and an end point thereof are aligned as shown in the drawing. In this case, it is difficult to obtain an adequate compression ratio.

As shown in FIG. SB, an end of the thick line positioned outside is moved clockwise along the envelope, and the other end positioned inside is moved to a point and comes into contact with the rotary shaft coupler. That is, a portion of the envelope adjacent to the rotary shaft coupler is bent to have a smaller radius of curvature.

As described above, due to characteristics of the scroll compressor, the compression chamber is formed by two contact points at which the orbiting wrap and the fixed wrap meet each other. Both ends of the thick line in FIG. 8A correspond to the two contact points. Due to an operation principle of the scroll compressor, normal vectors at the contact points are disposed in parallel to each other. Also, these normal vectors are parallel to a line that connects the center of the rotation shaft and a center of the eccentric bearing. However, when the fixed wrap and the orbiting wrap have involute shapes, the two normal vectors are not only parallel to each other but also coincide with each other, as shown in FIG. 6A.

Figure 6A:
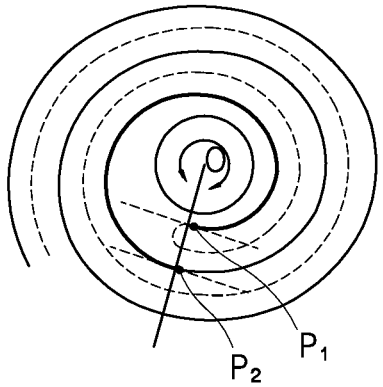
FIGS. 6A to 6E are views illustrating a process of obtaining an envelope in the scroll compressor according to an embodiment.

That is, in FIG. 6A, when a center of the rotary shaft coupler 146 is referred as "O" and the two contact points are referred to as $P_1$ and $P_2$, respectively, $P_2$ is positioned on a straight line that connects G and $P_1$. When an angle among angles formed by a line $OP_1$ and a line $OP_2$ is referred to as α, α is 360°. In addition, when a distance between normal vectors at $P_1$ and $P_2$ is referred to as l, l is 0.

Figure 6B:
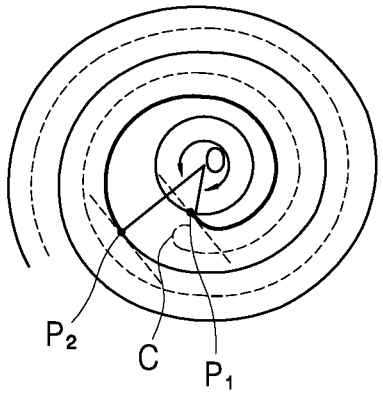

When $P_1$ and $P_2$ are moved inward along the envelope, a compression ratio of the first compression chamber may be increased. For this, when $P_2$ is moved toward the rotary shaft coupler 146, in other words, when the envelope for the first compression chamber is bent toward the rotary shaft coupler 146 and moved, the point $P_1$ having the normal vector parallel to the normal vector at the point $P_2$ is positioned at a location shifted clockwise in comparison to FIG. 6A, as shown in FIG. 6B. As described above, as a volume of the first compression chamber is decreased as the first compression chamber moves inward along the envelope. In FIG. 6B, the first compression chamber moves inward in comparison to FIG. 6A and is further compressed by as much as the movement such that the compression ratio is increased.

Figure 6C:
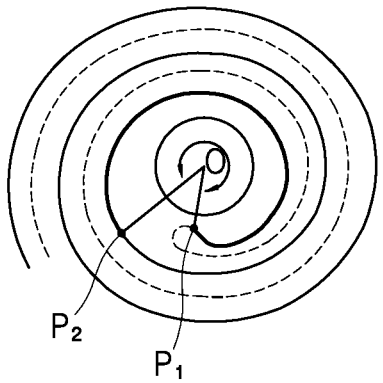
Figure 6D:
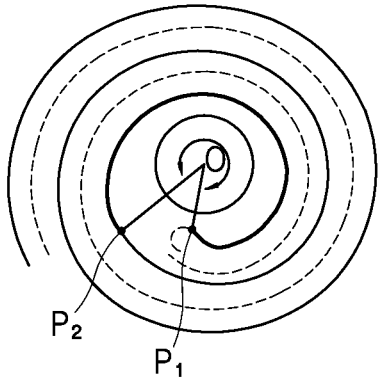

In FIG. 6B, the point $P_1$ is excessively close to the rotary shaft coupler 148, and a thickness of the rotary shaft coupler 146 is reduced and cannot provide adequate rigidity. Accordingly, the envelope is corrected, as shown in FIG. 6C, by moving the point $P_2$ back again. However, in FIG. 6C, as the envelopes for the first compression chamber and the second compression chamber are excessively close to each other such that a wrap thickness is excessively small or it is impossible to physically form the wraps, the envelope for the second compression chamber is corrected to allow the two envelopes to remain at a certain interval, as shown in FIG. 6D.

Figure 6E:
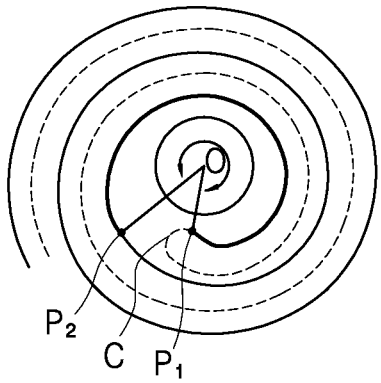

In addition, the envelope is corrected, as shown in FIG. 6E, to allow a circular arc portion C positioned at an end of the envelope of the second compression chamber to come, into contact with the envelope of the first compression chamber. Also, when the two envelopes are corrected to maintain the certain interval therebetween and a radius of the circular arc portion C of the envelope of the second compression chamber is increased to secure wrap strength at an end of the fixed wrap, the envelopes having a shape shown in FIG. 7 are obtained.

Figure 7:
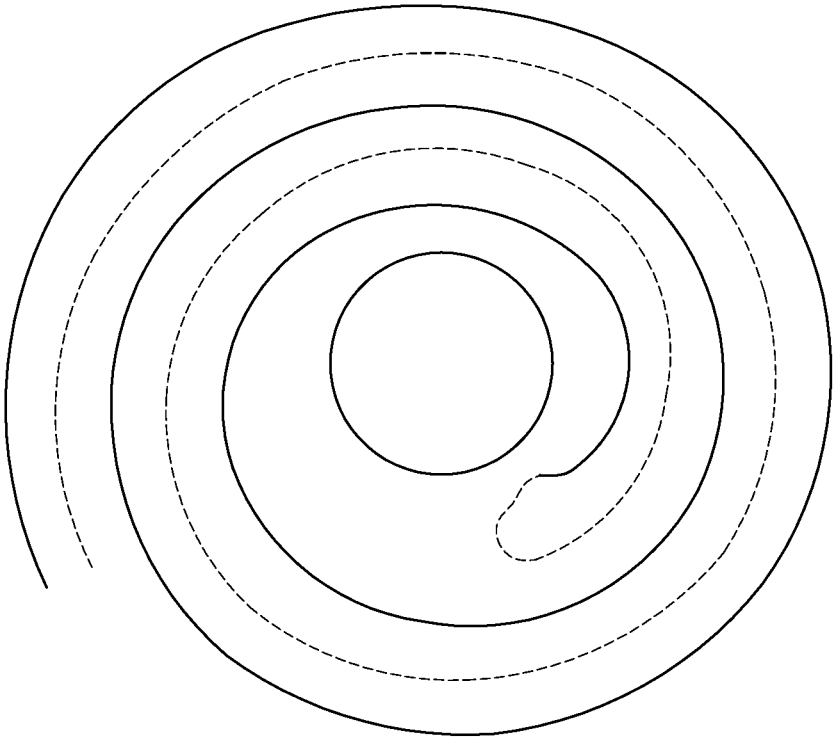
FIG. 7 is a plan view illustrating a final envelope of the embodiment shown in FIG. 8.
Figure 8:
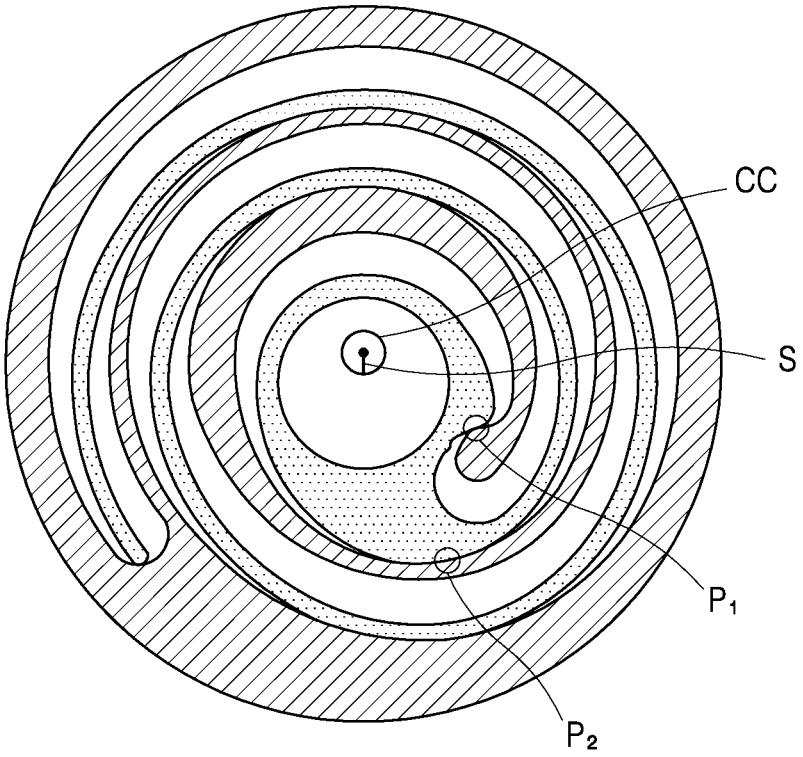
Figure 9:
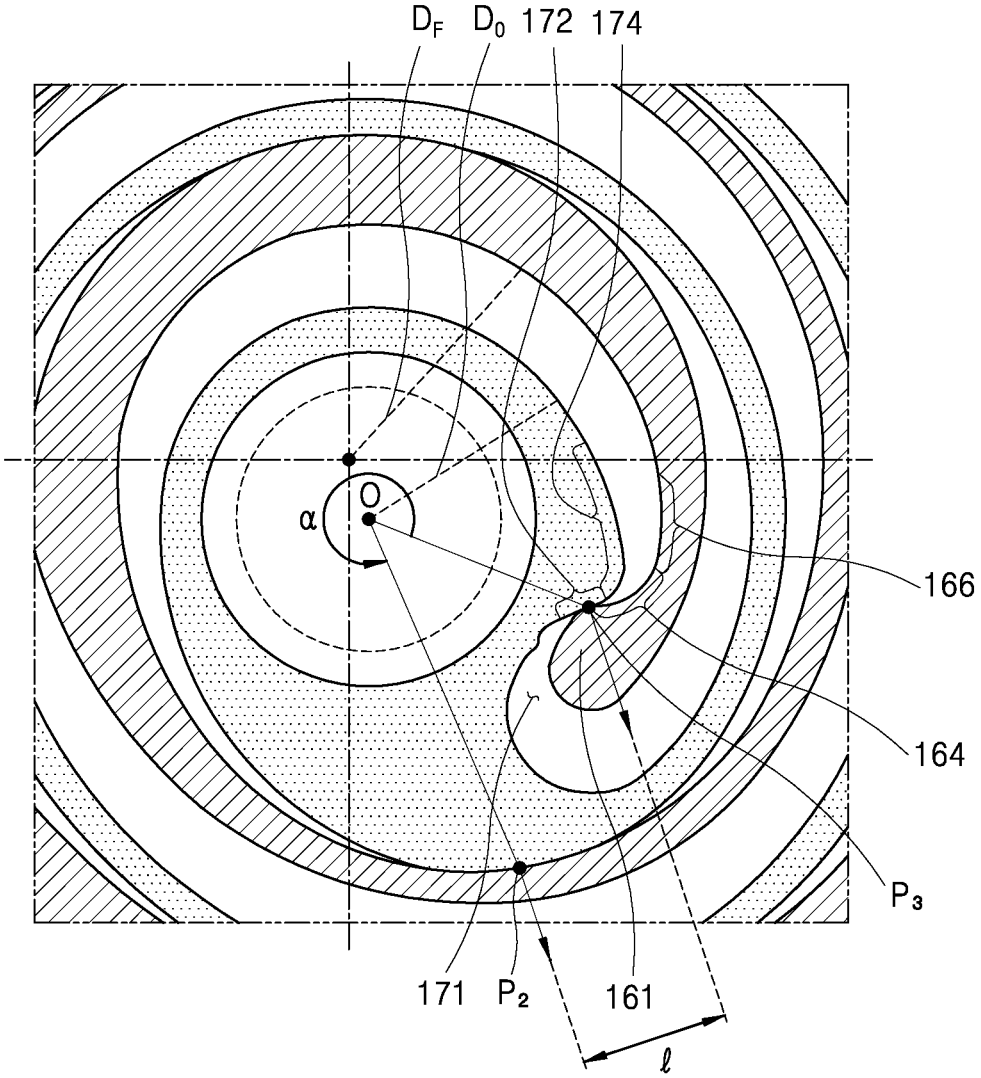
FIG. 9 is a plan view illustrating an orbiting wrap and a fixed wrap obtained by the envelope shown in FIG. 7.

FIG. 8 is a plan view illustrating a completed orbiting wrap and fixed wrap based on the envelopes in FIG. 7. FIG. 9 is an enlarged plan view of a central portion shown in FIG. 8.

FIG. 8 illustrates a position of the orbiting wrap at a time point at which discharge is started in the first compression chamber, $P_1$ in FIG. 8 is an inner contact point of the two contact points that define the first compression chamber when the discharge is started in the first compression chamber, and is shown as $P_3$ in FIG. 9. Line S is a virtual line for indicating a position of the rotary shaft, and circle CC is a path formed by the line S.

Hereinafter, a crank angle is defined as 0° when the line S is disposed as shown in FIG. 8, that is, when discharge is started, the crank angle is defined as having a negative value (−) when rotated counterclockwise and is defined as having a positive value (+) when rotated clockwise.

Referring to FIGS. 8 and 9, it can be seen that α defined by two straight; lines that connect the two contact points $P_1$ and $P_2$ to the center O of the rotary shaft coupler is less than about 360° and the distance l between the normal vectors at the contact points is also greater than 0°. Due to this, as a volume is smaller in comparison to a case in which the first compression chamber includes the fixed wrap and the orbiting wrap formed of involute curves, a compression ratio is increased. Also, the orbiting wrap and the fixed wrap shown in FIG. 8 have shapes formed by connecting a plurality of circular arcs, which have different diameters and starting points, and an outermost curve has an approximately oblong shape having a major axis and a minor axis.

In this embodiment, α is set to have a value between about 270 and 345°. From the aspect of improving a compression ratio, it is effective to set a to be small. However, when α is set to be smaller than about 270°, mechanical processing thereof is difficult such that productivity is not high and a cost of the compressor is increased. Also, when α exceeds about 345°, the compression ratio is decreased to 2.1 or below and it is impossible to provide an adequate compression ratio.

A protrusion 161 that protrudes toward the rotary shaft coupler 148 is formed near an inner end of the fixed wrap. That is, the inner end of the fixed wrap is formed to have a greater thickness than other components. Due to this, as it is possible to increase a wrap strength of the inner end of the fixed wrap which receives a greatest compression force, durability may be increased.

The thickness of the fixed wrap is gradually reduced from the inner contact point $P_3$ among the two contact points that form the first compression chamber at a time point at which discharge is started, as shown in FIG. 9. That is, a first reducing portion 164 adjacent to the contact point $P_3$ and a second reducing portion 166 connected to the first reduction portion 184 are formed, and a thickness reduction rate of the first reducing portion 164 is greater than a thickness reduction rate of the second reducing portion 166. Also, after the second reducing portion 186, the fixed wrap increases in thickness over a certain section.

Figure 11:
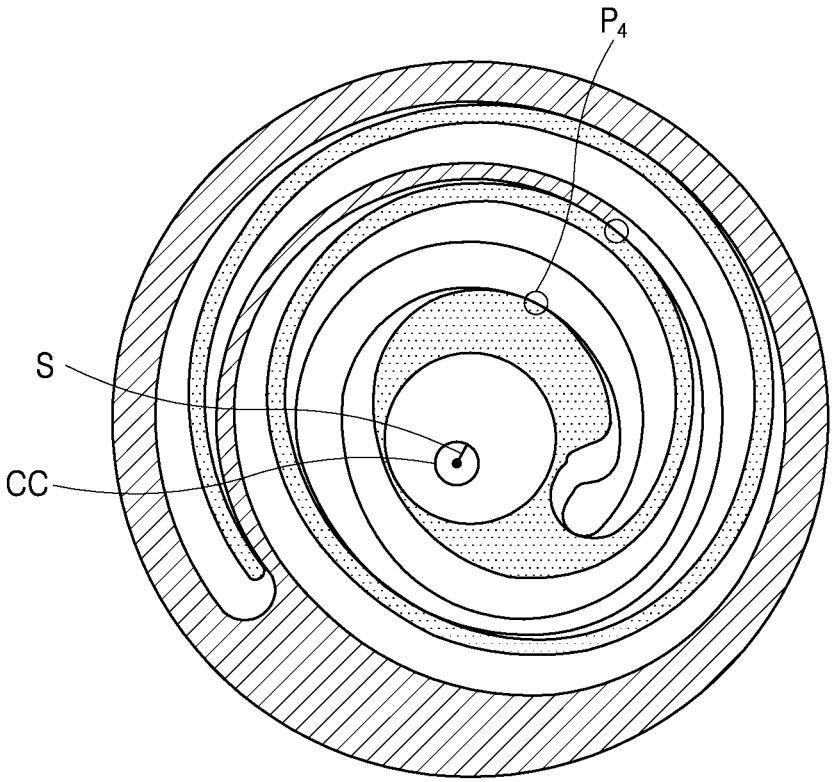
FIG. 11 is a plan view illustrating a state in which a crank angle is at a position of about 150°.

A distance between the inner surface of the fixed wrap and a shaft center O' of the rotary shaft 126 is referred to as $D_F$, $D_F$ is gradually increased in a counterclockwise direction from $P_3$ (based on FIG. 9), and is then reduced, and a section thereof is shown in FIG. 11. FIG. 11 is a plan view illustrating a position of the orbiting wrap when the crank angle of the rotary shaft is about 150° before starting discharge, that is, the crank angle is about 150°.

When the rotary shaft rotates about 150° from the state shown in FIG. 11, the rotary shaft 126 changes to the state shown, in FIG. 8. Referring to FIG. 11, a contact point $P_4$ which is one of the two contact points and is positioned inside, is positioned above the rotary shaft coupler 146, and $D_F$ is increased and then reduced in a section between $P_3$ in FIG. 9 and $P_4$ in FIG. 11.

A recess 171 for engaging with the protrusion 183 may be formed at the rotary shaft coupler 146. One sidewall of the recess 171 may come into contact with the protrusion 181 and form one side contact point of the first compression chamber. When a distance between the center O of the rotary shaft coupler 146 and the outer circumferential portion of the rotary shaft coupler 146 is referred to as Do, Do is increased and then reduced in the section between $P_3$ in FIG. 9 and $P_4$ in FIG. 11. Likewise, the thickness of the rotary shaft coupler 146 is also increased and then reduced in the section between $P_3$ in FIG. 9 and $P_4$ in FIG. 11.

Also, the one sidewall of the recess 171 may include a first increasing portion 172 in which the thickness is increased relatively quickly and a second increasing portion 174 connected to the first increase portion and in which the thickness is increased at a relatively slow rate. These portions correspond to the first reducing portion 184 and the second reducing portion 166 of the fixed wrap 138. The first increasing portion 172, the first reducing portion 164, the second increasing portion 174, and the second reducing portion 166 are obtained as a result of bending the envelope toward the rotary shaft coupler 146 to FIG. 6B. Due to the portions, the inner contact point $P_1$, which forms the first compression chamber, is positioned at the first increasing portion 172 and the second increasing portion 174 and reduces a length of the first compression chamber immediately before discharge to eventually increase the compression ratio.

The other sidewall of the recess 171 may be formed to have the shape of a circular arc. A diameter of the circular arc is determined by a wrap thickness of the end 161 of the fixed wrap and the orbital radius of the orbiting wrap. When the thickness of the end 161 of the fixed wrap is increased, the diameter of the circular arc is increased. Due to this, a thickness of the orbiting wrap around the circular arc is also increased to provide durability, and a compression path is lengthened to increase the compression ratio of the second compression chamber by as much as the increase.

Figure 12:
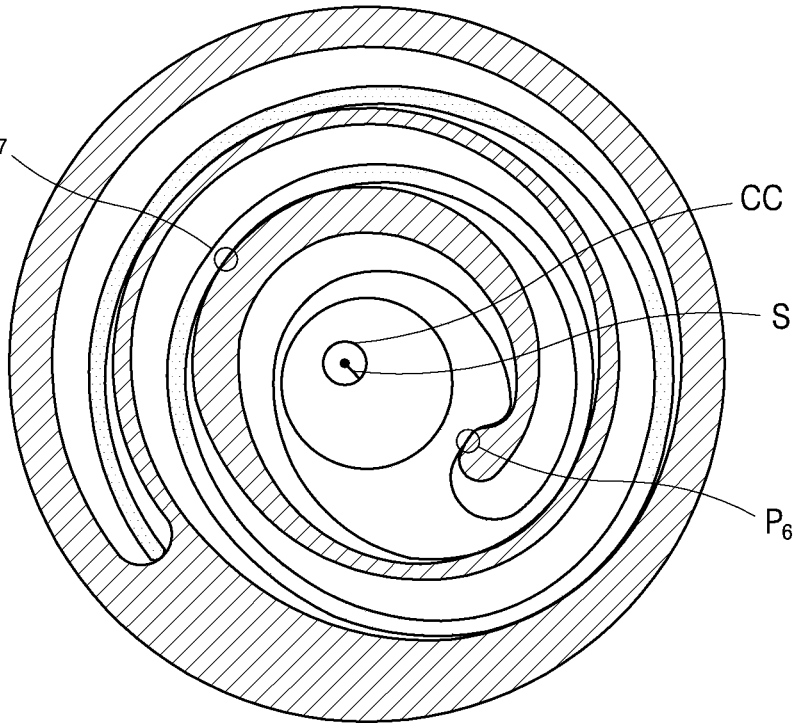
FIG. 12 is a plan view illustrating a time point at which discharge is started in the second compression chamber in the embodiment shown in FIG. 8.

A central portion of the recess 171 forms a portion of the second compression chamber. FIG. 12 is a plan view illustrating a, position of the orbiting wrap at a time at which discharge from the second compression chamber is started, and the second compression chamber is defined by two contact points $P_6$ and $P_7$ in FIG. 12 and is in contact with the arc-shaped sidewall of the recess 171, and one end of the second compression chamber passes the central portion of the recess 171 when the rotary shaft 126 rotates a little more.

Figure 10:
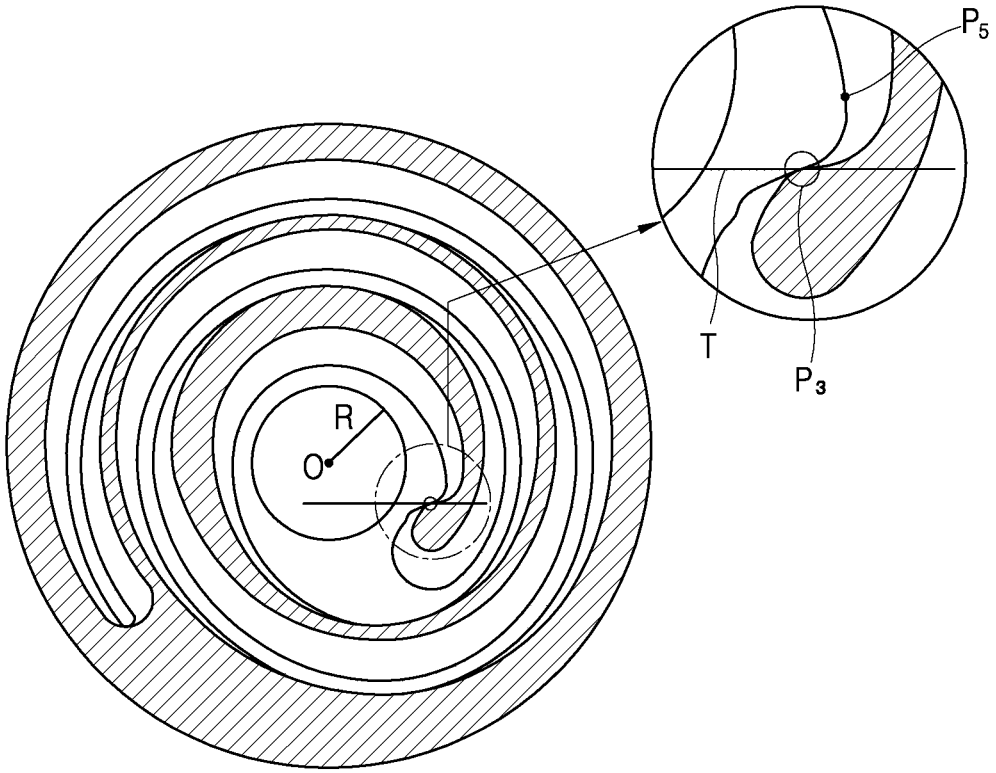
FIG. 10 is another enlarged plan view illustrating the center in FIG. 8.

FIG. 10 is another plan view illustrating the stele shown in FIG. 9. Referring to FIG. 10, it can be seen that a tangent T drawn at $P_3$ passes through an inside of the rotary shaft coupler 146. The above-described result is obtained by bending the envelopes inward in the process shown in FIG. 6B. A distance between the tangent T and the center O of the rotary shaft coupler 146 is smaller than a diameter of the inside of the rotary shaft coupler 146.

Also, $P_5$ in FIG. 10 refers to an inner contact point in a case in which the crank angle is about 90°. As shown in the drawing, a radius of curvature of the outer circumferential portion of the rotary shaft coupler 148 has various values depending on each point between $P_3$ and $P_5$.

Generally, a compressor for air conditioning may have a compression ratio of about 2.3 or more when used in a two-way air conditioner, and may have a compression ratio of about 2.1 or more when used for air-conditioning.

$P_5$ is not limited to the case in which the crank angle is about 90°. However, as a degree of freedom in design for a radius of curvature beyond about 90° is low due to an operation principle of the scroll compressor, a shape may be changed within a range from about 0° to about 90° to have a relatively high degree in freedom for increasing a compression ratio.

Hereinafter, a discharge structure through which a refrigerant discharged from the first compression chamber and the second compression chamber will be described. As the first compression chamber and the second compression chamber perform compression along the envelopes, a refrigerant compressed so the first compression chamber and a refrigerant compressed in the second compression chamber are discharged through the first discharge hole and the second discharge hole and move to the inside of the casing. Positions of the discharge holes may be arbitrarily set in consideration of necessary discharge pressures.

Figure 13:
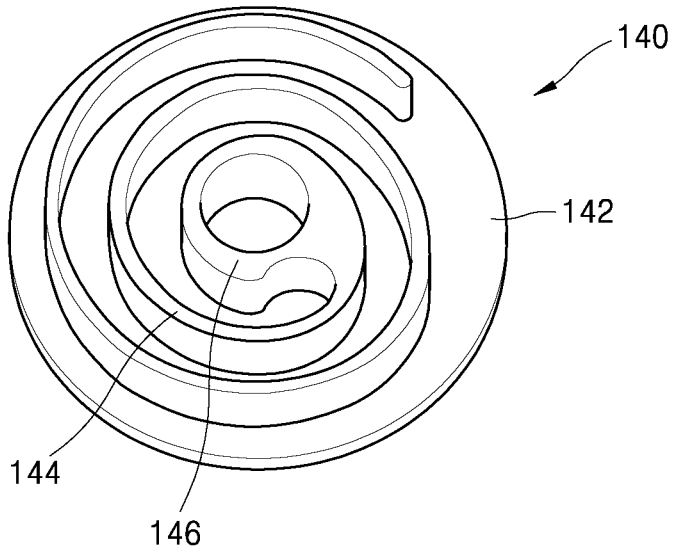
FIG. 13 is a view illustrating an orbiting scroll and a fixed scroll of the scroll compressor.
Figure 13:
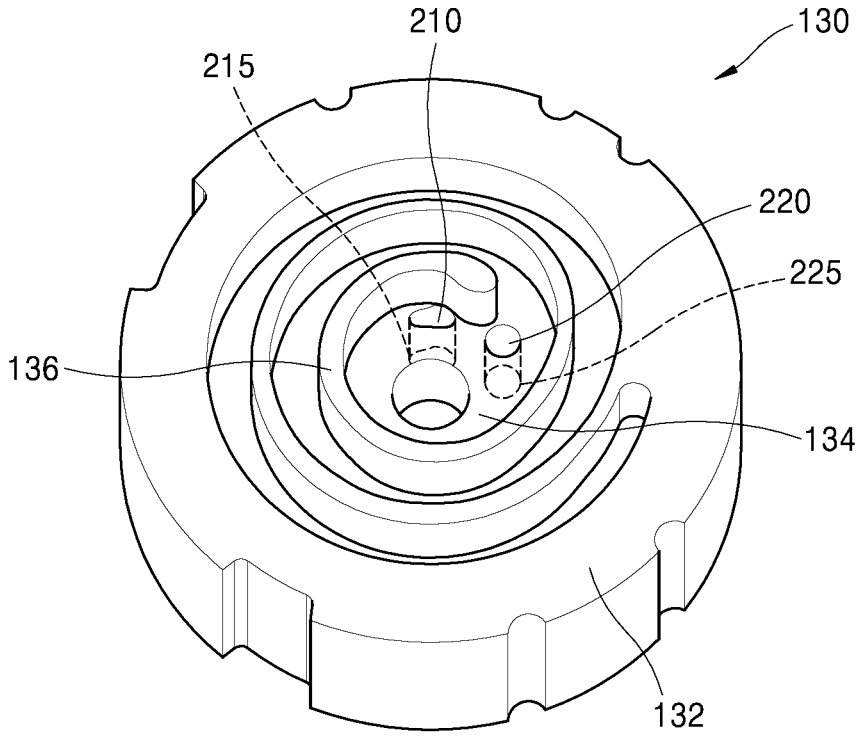

FIG. 13 is a view illustrating the orbiting scroll and the fixed scroll of the scroll compressor according to an embodiment. As shown in the drawing, the orbiting scroll 140 may include the orbiting end plate 142 having a circular plate shape, the rotary shaft coupler 148, and the orbiting wrap 144. The rotary shaft coupler 148 may be a component to which the eccentric portion is fixed, and which may be connected to and integrated with the orbiting wrap 144.

The fixed scroll 130 may include the fixed end plate 134 and the fixed wrap 136. The fixed end plate 134 may include discharge holes to discharge a refrigerant compressed in the compression chamber.

The discharge holes may be formed at the fixed end plate 134 of the fixed scroll 130 to have a through hole shape. A discharge hole at a side of the compression chamber, which is an inner surface of the fixed end plate 134 (a surface facing the orbiting scroll 140), may be referred to as a "discharge inlet", and a discharge hole at an outer surface of the fixed end plate 184 (a surface facing the casing 110) may be referred to as a "discharge outlet".

A first discharge inlet 210 and a first discharge outlet 215 discharge the refrigerant compressed in the first compression chamber, and a second discharge inlet 220 and a second discharge outlet 226 discharge the refrigerant compressed in the second compression chamber. However, as described above, the second compression chamber has a bent inside portion such that there is a limitation in providing an opening area of the second discharge inlet at a time point at which discharge of the second compression chamber is started.

When an adequate opening, area of the discharge inlet is not provided, an excessive discharge loss occurs and causes a decrease in overall performance of the compressor. According to the embodiments disclosed herein, there is provided a structure for reducing discharge resistance which is applied to the refrigerant compressed in the second compression chamber at an initial stage of discharge.

Movement of the compressed refrigerant is caused, by a pressure difference. A flow rate and a flew velocity are determined by the pressure difference and a cross section of a flow channel. Accordingly, when an adequate opening area of the discharge inlet is not provided, discharge resistance becomes greater. Accordingly, it is impossible to provide a necessary discharge flow rate.

To overcome the above-described limitation, the scroll compressor according to embodiments disclosed herein may include a connection groove, which connects the first discharge inlet and the second discharge inlet, at an inner surface of the fixed end plate 134 of the fixed scroll 130. The connection groove may be formed at the fixed end plate 134 of the fixed scroll 130 in a concave groove shape. The connection groove, like the discharge inlets, may be opened or covered depending on an orbiting movement of the orbiting scroll.

Figure 14:
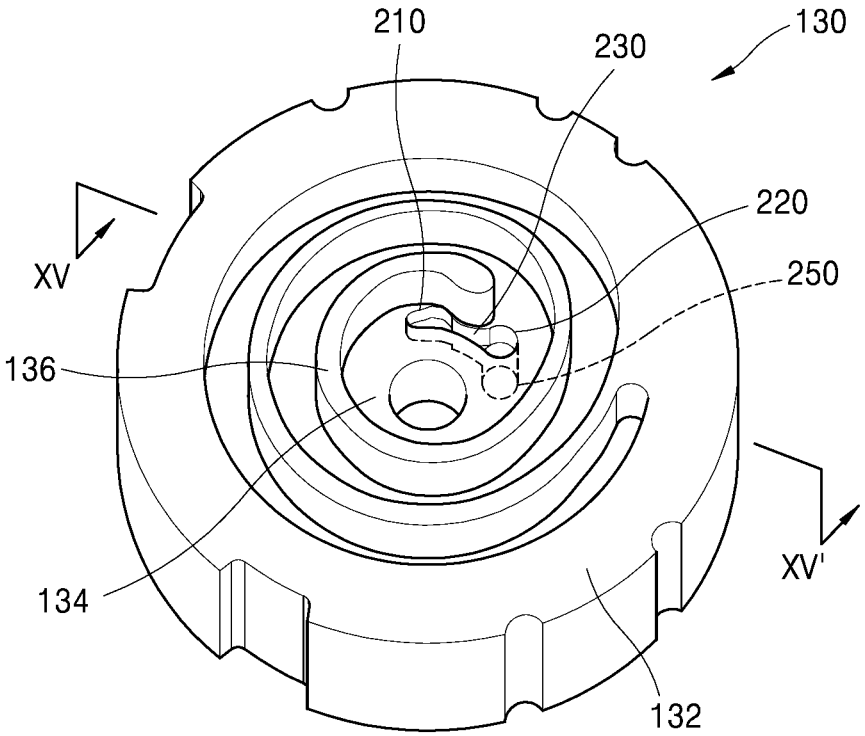
FIG. 14 is a perspective view of a fixed scroll of a scroll compressor having an improved discharge structure according to an embodiment.
Figure 15:
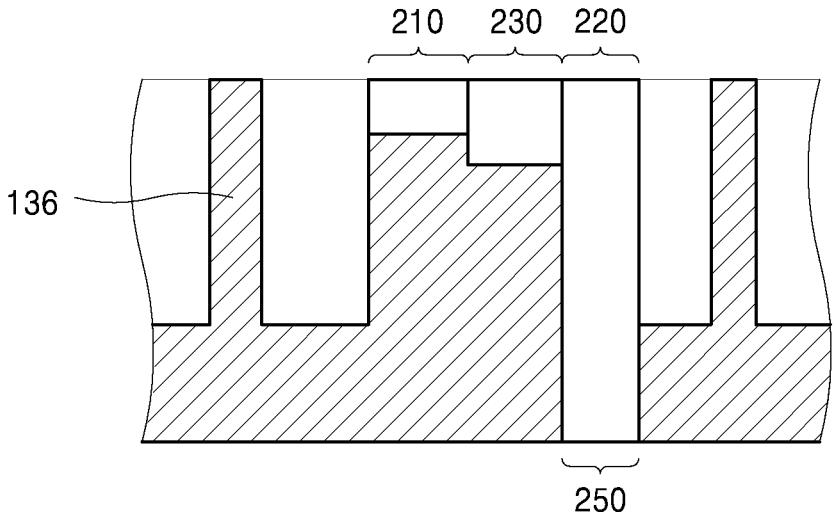
FIG. 15 is a cross-sectional view illustrating discharge holes of the scroll compressor according to an embodiment taken along line XV-XV' of FIG. 14.
Figure 16:
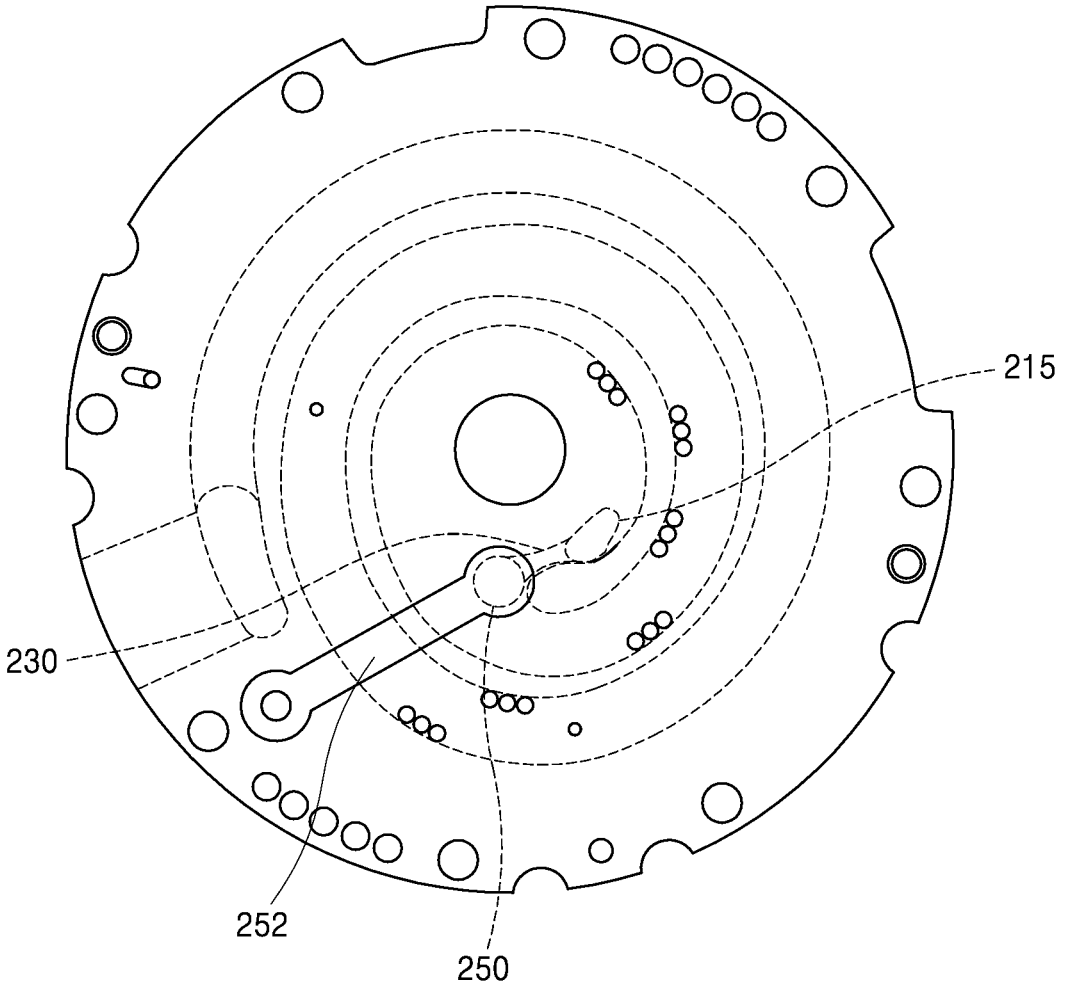
FIG. 16 is a view illustrating a discharge valve of the scroll compressor according to the embodiment of FIG. 15.

FIG. 14 is a perspective view of a fixed scroll of a scroll compressor having an improved discharge structure according to an embodiment. FIG. 15 is a cross-sectional view illustrating a discharge hole of the scroll compressor according to an embodiment, taken along line XV-XV' of FIG. 14. FIG. 16 is a view illustrating a discharge valve of the scroll compressor according to the embodiment of FIG. 15.

Referring to FIGS. 14 and 16, the fixed scroll according to this embodiment may include the first discharge inlet 218, the second discharge inlet 220, and a connection groove 230 at the inner surface of the fixed end plate 134. The connection groove 230 may be formed as a concave groove at the inner surface of the fixed end plate 134.

The first discharge inlet 210 may pass through the fixed end plate 134 and be connected to a single discharge outlet 250. The second discharge inlet 220 may not pass through the fixed end plate 134, may be formed in a groove shape, may pass through the connection groove 230, and be connected to the discharge outlet 250.

The first discharge inlet 210 and the second discharge inlet 220 of the fixed end plate 134 are formed, and then the first discharge inlet 210 and the second discharge inlet 220 may be connected by the connection groove 230 such that the two discharge inlets 210 and 220 are connected to the single discharge outlet 250. Accordingly, as only one discharge valve 252 is necessary, an effect of reducing a valve hitting sound that occurs when the discharge valve 252 operates is provided.

In the embodiment shown in the drawing, the second discharge inlet 220 has a larger opening area and the discharge outlet 250 is disposed in parallel to the second discharge inlet 220 in an axial direction. However, when the first discharge inlet 210 has a larger opening area, the discharge outlet 280 may be disposed in parallel to the first discharge inlet 210. This reduces flew channel resistance when the compressed refrigerant is discharged. In other words, the discharge outlet 250 is disposed in parallel to one inlet among the two discharge inlets 210 and 220 which has a relatively larger area (opening area) and the other inlet which has a relatively smaller area may be connected to the discharge outlet 250 through the connection groove 230.

A flow channel cross section (a vertical cross section) of the connection groove 230 may the same as or larger than the area of the first discharge inlet 210 (the discharge inlet having a relatively smaller cross section). This reduces a flow loss that occurs when a refrigerant, which passes through the first discharge inlet 210, passes through the connection groove 230.

As another example, all of the first discharge inlet 210, the second discharge inlet 220, and the connection groove 230 may be formed as through holes that pass through the fixed end plate 134 and may be connected to a single discharge outlet 250. In other words, a first discharge hole and a second discharge hole may be connected to a connection groove in one through hole. In this case, as one discharge outlet is formed, only one discharge valve may be used.

Figure 17:
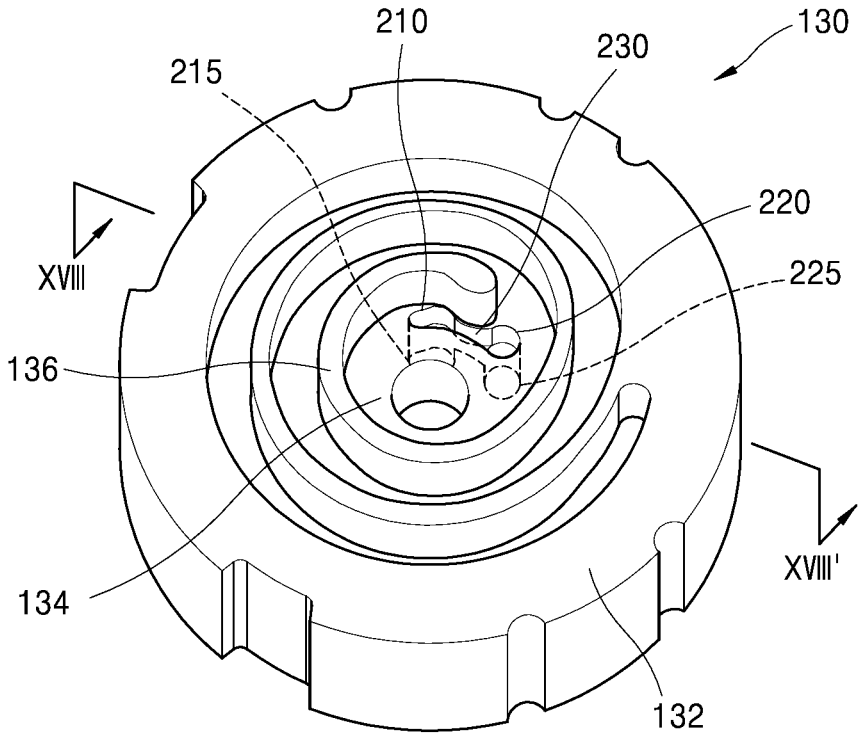
FIG. 17 is a perspective view of a fixed scroll of a scroll compressor having an improved discharge structure according to another embodiment.
Figure 18:
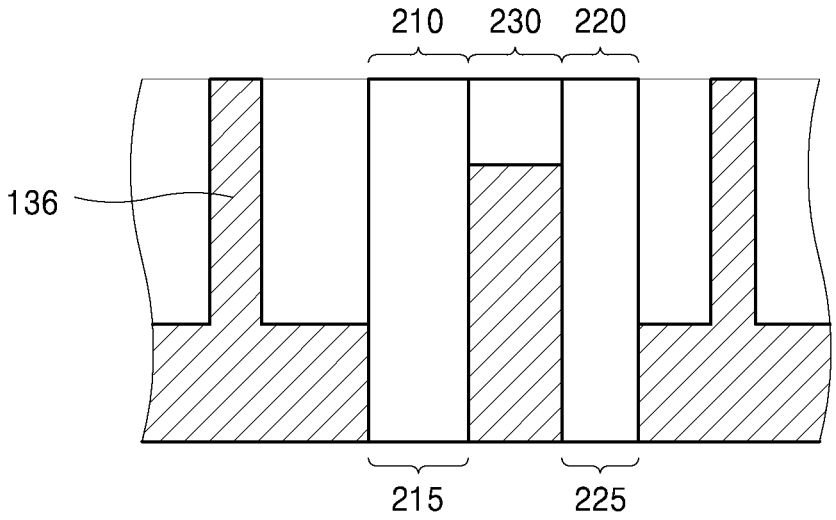
FIG. 18 is a cross-sectional view illustrating discharge holes of the scroll compressor according to the embodiment of FIG. 17, taken along line XVIII-XVII' of FIG. 17.
Figure 19:
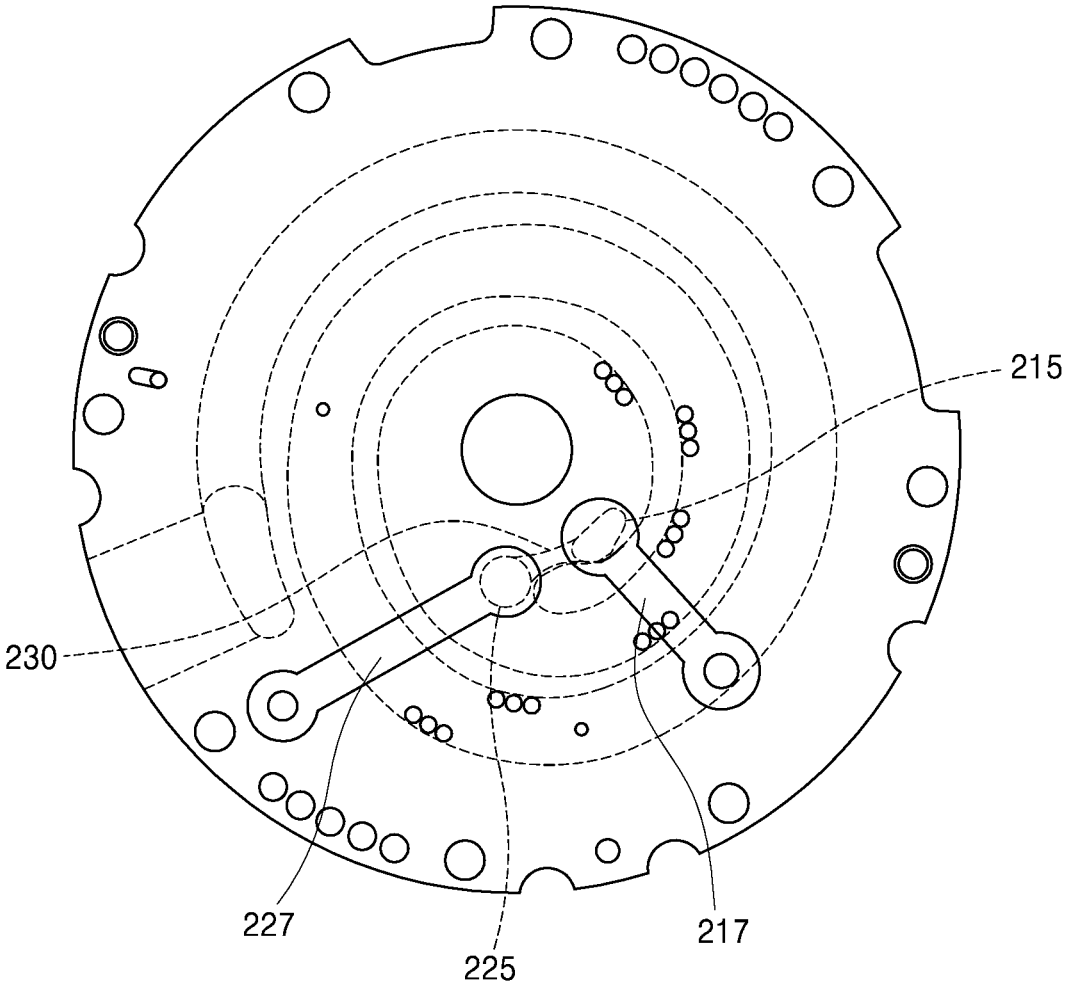
FIG. 19 is a view illustrating a discharge valve of the scroll compressor according to the embodiment of FIG. 17.

FIG. 17 is a perspective view of a fixed scroll of a scroll compressor having an improved discharge structure according to another embodiment. FIG. 18 is a cross-sectional view illustrating discharge holes of the scroll compressor according to the embodiment of FIG. 17, taken along line XVIII-XVIII' of FIG. 17. FIG. 19 is a view illustrating a discharge valve of the scroll compressor according to the embodiment of FIG. 17.

The scroll compressor according to this embodiment has a form in which the first discharge inlet 210 and the second discharge inlet 220 pass through the fixed end plate 134 and are connected to the first discharge outlet 215 and the second discharge outlet 225, respectively. In this case, the connection groove 230 that connects the first discharge inlet 210 to the second discharge inlet 220 is provided so that the discharge inlets 210 and the 220 and the discharge outlets 215 and 225 may be connected to each other. When the discharge inlets 210 and 220 are connected, as will be described below, the refrigerant compressed in the second compression chamber may be discharged through the first discharge inlet 210 or the connection groove 230 at the beginning of the discharge of the second compression chamber.

Figure 20:
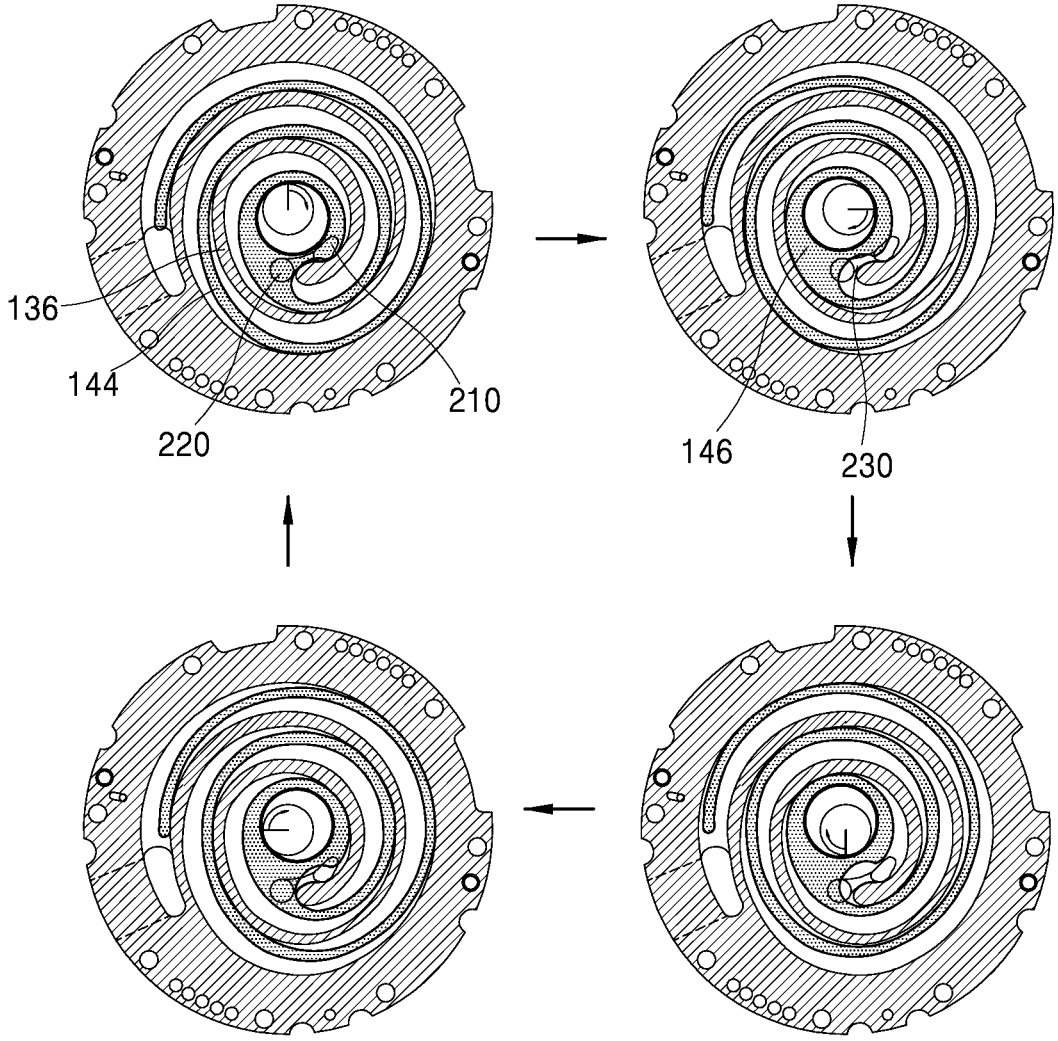
FIG. 20 is a view illustrating an orbiting operation of the orbiting scroll of the scroll compressor according to an embodiment.

FIG. 20 is a view illustrating an orbiting operation of the orbiting scroll of the scroll compressor according to an embodiment. FIGS. 21 to 25 are views illustrating states in which the crank angle incrementally moves about 10° clockwise starting from a discharge-starting time point of a second compression chamber shown in FIG. 21.

Figure 21:
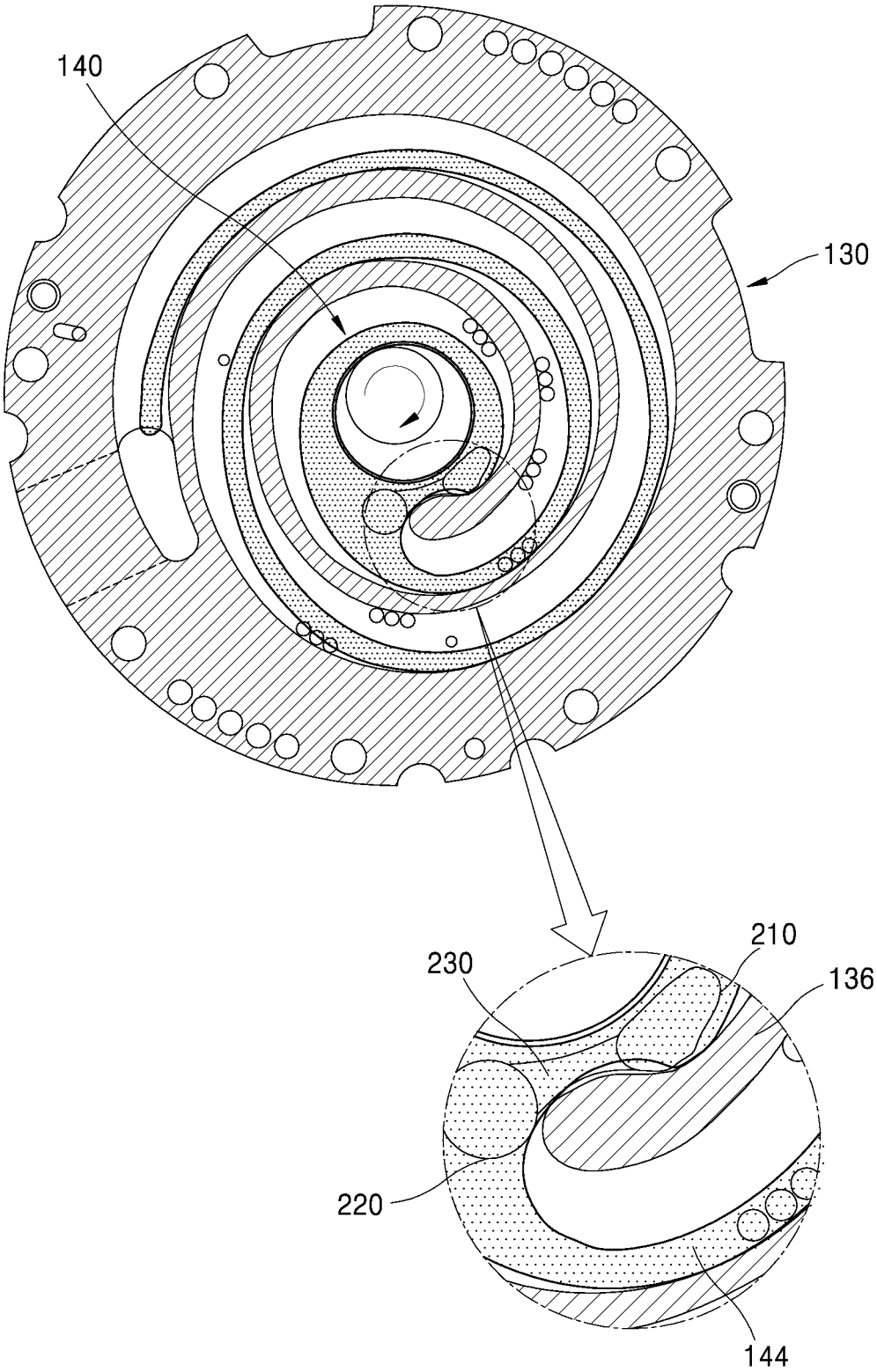
FIGS. 21 to 25 are views illustrating states in which a crank angle incrementally moves about 10° clockwise starting from a discharge-start time point of a second compression chamber shown in FIG. 21.

In the illustrated embodiment, a shape in which the orbiting scroll rotates clockwise is shown. The state shown in FIG. 21 shows a time point at which the discharge of the second compression chamber is started. States in which the orbiting scroll incrementally rotates about 10° starting from a crank angle at the time point at which the discharge of the second compression chamber is started are shown in FIGS. 21 to 25.

Referring to FIG. 21, the second discharge inlet 220 is completely covered by the orbiting wrap 144 of the orbiting scroll 140, but when the orbiting scroll 140 is additionally rotated, the second discharge inlet 220 enters the second compression chamber and discharge is started. As the discharge of the second compression chamber is started in the state shown in FIG. 21, the state of FIG. 21 may be referred to as the discharge-starting time point.

As the connection groove 230 formed at the fixed end plate 134 is covered by the orbiting wrap 144 at the discharge-starting time point of FIG. 21, movement of a refrigerant through the connection groove 230 is not performed in this state. In other words, there are no overlapping areas between the connection groove 230 and the inside of the second compression chamber at the discharge-starting time point.

Figure 22:
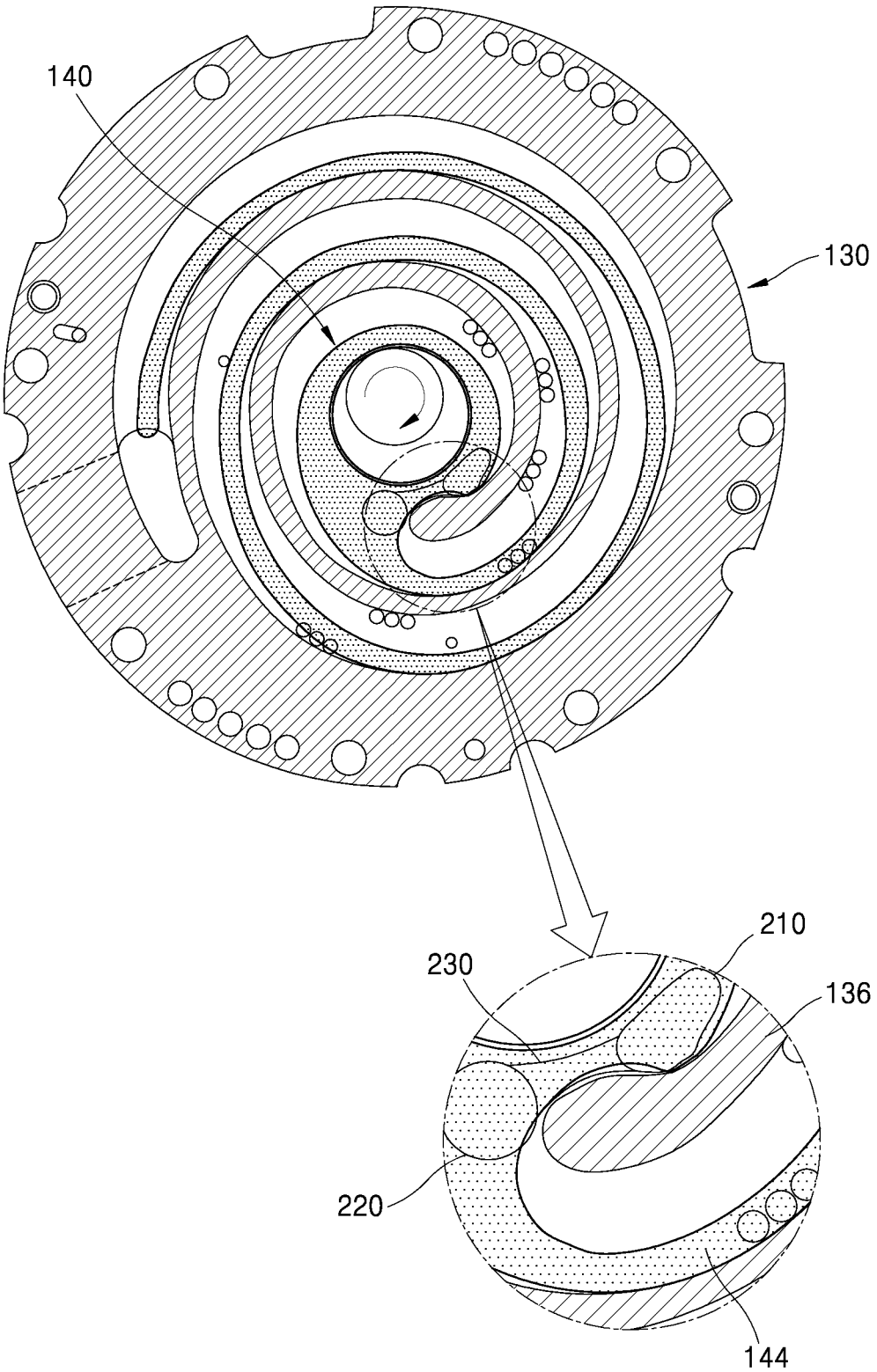

FIG. 22 illustrates a state in which the crank angle rotates clockwise by about 10° from the state shown in FIG. 21. It can be seen that the orbiting wrap 144 rotates by about 10° with respect to the fixed wrap 138.

In the state of FIG. 22, the second discharge inlet 220 enters the second compression chamber such that the refrigerant compressed in the second compression chamber is discharged through the second discharge inlet 220. However, it can be seen that an overlapping area between the second discharge inlet 220 and the second compression chamber is very small. Although the second discharge inlet 220 enters the second compression chamber, it is impossible to smoothly discharge the compressed refrigerant only through the second discharge inlet 220 due to a small opening area.

Figure 23:
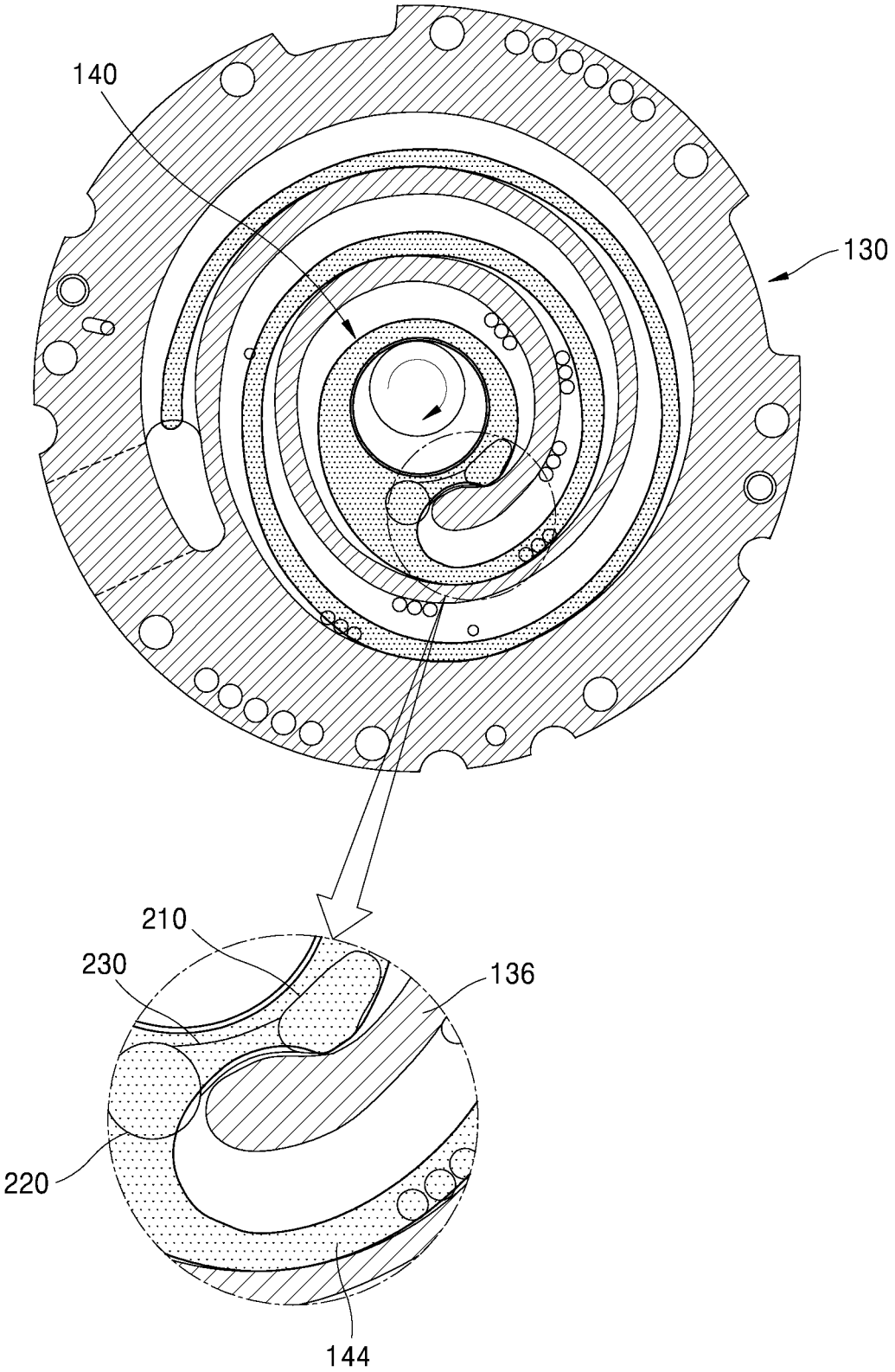

FIG. 23 illustrates a state in which the crank angle rotates clockwise by about 10° from the state shown in FIG. 22. It can be seen that the orbiting wrap 144 further rotates by about 10° in comparison to FIG. 22.

When compared with FIG. 22, it can be seen that the opening area of the second discharge inlet 220 is increased and the connection groove 230 enters the second compression chamber. When looking at a position of the connection groove 230 in FIG. 22, the connection groove 230 is deviated from the orbiting wrap 144 and is exposed in the second compression chamber. In this state, the compressed refrigerant may flow through the connection groove 230 at a portion, thereof exposed in the second compression chamber, and then may be discharged through the discharge outlet. In other words, as the compressed refrigerant may be discharged through the open portion of the connection groove 230, an effect of enlarging the opening area at the beginning of discharge is provided.

Figure 24:
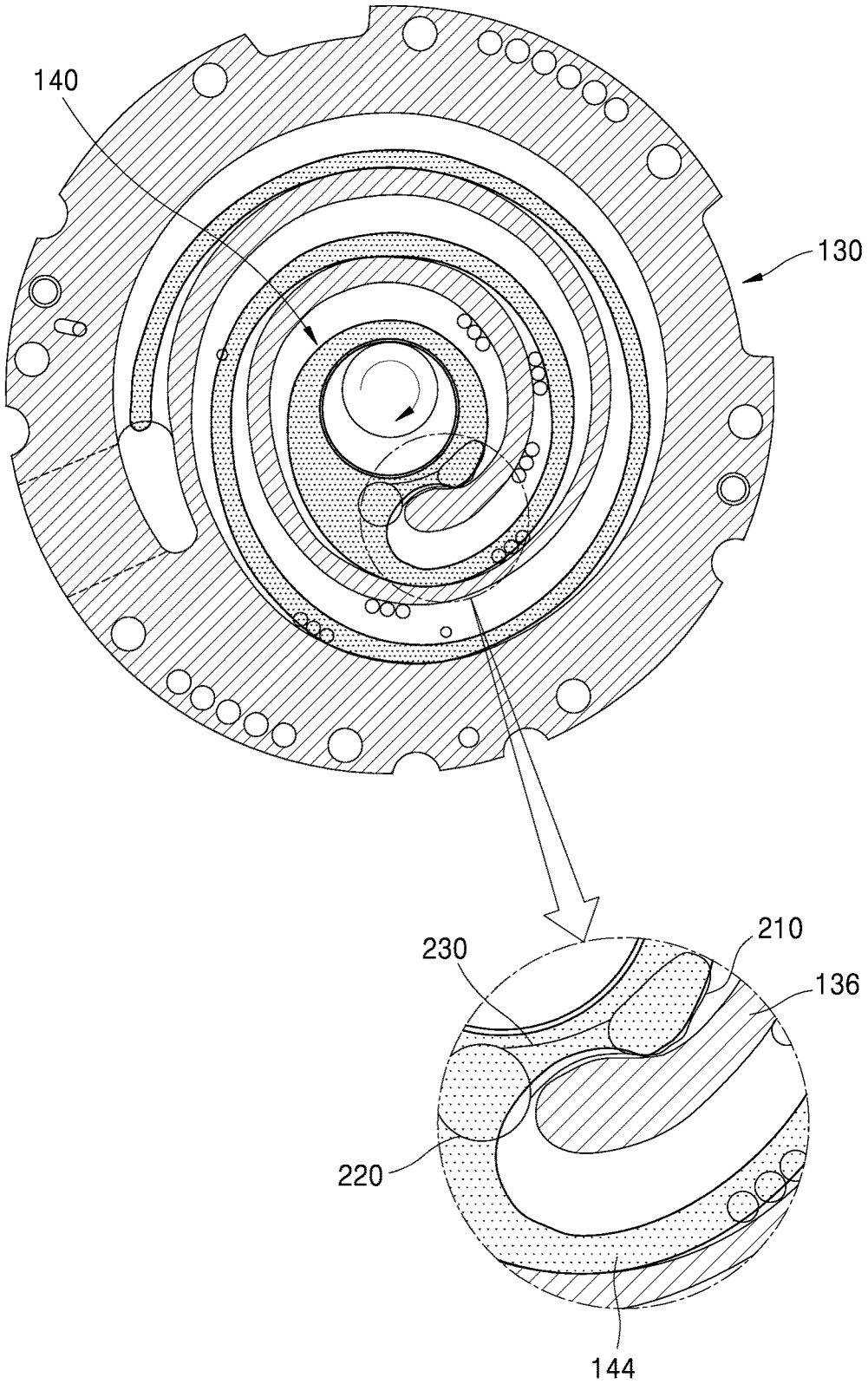

FIG. 24 illustrates a state in which the crank angle rotates clockwise by about 10° from the state of FIG. 23. Referring to FIG. 24, it can be seen that the opening area of the second discharge inlet 220 in the second compression chamber is increased and an opening area of the first discharge inlet 210 in the second compression chamber is reduced. In this state, as the first discharge inlet 210 is connected to the second compression chamber without passing through the connection groove 230, an effect of the connection groove 230 is not significant.

Meanwhile, when looking at the first compression chamber in the state shown in FIG. 24, it can be seen that the first discharge inlet 210 is in a state immediately before being compressed in the first compression chamber, in other words, the first discharge inlet 210 is in a state immediately before entering the first compression chamber. In this state, when the crank angle additionally rotates clockwise, discharge of the first compression chamber is started.

Figure 25:
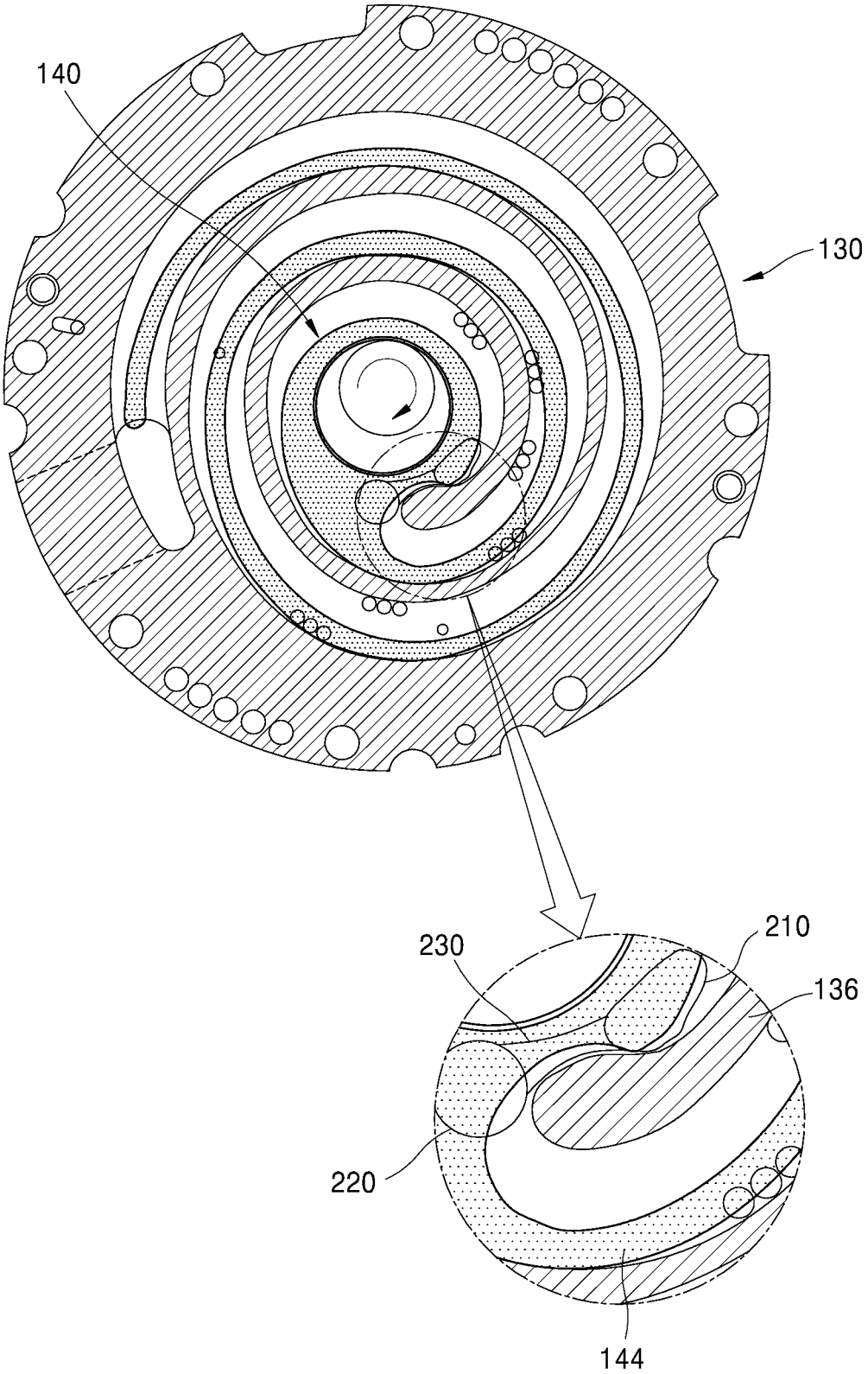

FIG. 25 illustrates a state in which the crank angle rotates clockwise by about 10° from the state of FIG. 24. Referring to FIG. 25, it can be seen that an opening area of the second discharge hole of the second compression chamber is increased and the first discharge inlet 210 enters the first compression chamber such that the discharge of the first compression chamber is performed.

In the case of the connection groove 230, it can be seen that a top and a lateral portion thereof deviate from the fixed wrap 136, as in the state shown in FIG. 24. However, as in the state shown in FIG. 22, due to an excessively small opening area in the second compression chamber, an effect caused by the connection groove 230 is not significant.

As described above, the scroll compressor according to this embodiment includes the connection groove 230 having a concave groove shape and formed at the inner surface of the fixed end plate 134 to provide the structure in which the first discharge inlet 210 and the second discharge inlet 220 are connected to a single discharge outlet, thereby providing effects of reducing the number of discharge valves and reducing a valve-hitting sound. Also, the connection groove 230 provides an effect of increasing the opening area of the discharge inlet at the beginning of the discharge of the second compression chamber.

According to embodiments disclosed herein, a scroll compressor has a structure with an improved compression ratio of a first compression chamber, which is formed between an outer surface of a fixed wrap and an inner surface of an orbiting wrap, to a second compression chamber, which is formed between an inner surface of the fixed wrap and an outer surface of the orbiting wrap. During an initial discharge in which a refrigerant compressed in the second compression chamber is discharged, the refrigerant compressed in the second compression chamber is also discharged through a connection groove that connects a first discharge inlet and a second discharge inlet. Accordingly, even when there is a lack of an opening area of the second discharge hole during the initial discharge of the second compression chamber, an effect of reducing an excessive-compression loss caused by a discharge delay is provided by using an opening area of the connection groove.

Also, the scroll compressor provides an effect of reducing the number of discharge valves by providing a structure in which a first discharge hole through which a refrigerant compressed in the first compression chamber is discharged and a second discharge hole through which a refrigerant compressed in the second compression chamber is discharged are connected to a single discharge outlet. The reduced number of discharge valves also provides an effect of reducing a valve-hitting noise.

Embodiments disclosed herein reduce a loss caused by a discharge delay that occurs during an initial discharge of a refrigerant, which is compressed in a compression chamber, in a scroll compressor using a fixed scroll and an orbiting scroll.

Embodiments disclosed herein provide a scroll compressor with a reduced number of discharge valves by connecting a plurality of discharge holes to a single discharge outlet. Embodiments disclosed herein also provide a scroll compressor in which a fixed scroll and an orbiting scroll are engaged to form a compression chamber and which has a discharge structure in which a first discharge inlet through which a refrigerant compressed in a first compression chamber is discharged and a second discharge inlet through which a refrigerant compressed in a second compression chamber is discharged are connected by a connection groove having a concave groove shape. Embodiments disclosed herein additionally provided a structure with a reduced number of discharge valves using a first discharge inlet and a second discharge inlet being connected by a connection groove such that a refrigerant is discharged through a single discharge outlet.

This application relates to U.S. application Ser. No. 15/860,135, U.S. application Ser. No. 15/830,161, U.S. application Ser. No. 15/830,184, U.S. application Ser. No. 15/830,222, and U.S. application Ser. No. 15/830,290, all filed on Dec. 4, 2017, which are hereby incorporated by reference in their entirety. Further, one of ordinary skill in the art will recognize that features disclosed in these above-noted applications may be combined in any combination with features disclosed herein.

The above-described embodiments should be understood as examples that are not limitative in all aspects, and the scope should be defined by the following claims rather than the above detailed description. Also, it should be understood that all modifiable and changeable shapes derived from the meaning and scope of the following claims and equivalents thereof are included in the scope of the present invention.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof. It should be understood that numerous other modifications and embodiments can be devised by those skilled in the aft that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing in which oil is stored in an oil storage chamber formed at a lower portion of the casing;

a drive motor provided in an inner space of the casing;

a main frame provided under the drive motor and fixed in the inner space of the casing;

a fixed scroll provided under the main frame and including a fixed end plate having an inner surface and an outer surface and a discharge outlet is disposed on the outer surface;

an orbiting scroll provided between the main frame and the fixed scroll and engaged with the fixed scroll to perform an orbiting movement to form first and second compression chambers with the fixed scroll, and a rotary shaft coupled to the drive motor and including a main bearing portion supported by the main frame, a sub bearing portion supported by the fixed scroll, and an eccentric portion eccentrically coupled to the orbiting scroll, the fixed end plate of the fixed scroll includes a first discharge inlet configured to discharge a refrigerant compressed in the first compression chamber, a second discharge inlet configured to discharge a refrigerant compressed in the second compression chamber, and a communication groove that connects the first discharge inlet and the second discharge inlet, wherein the second discharge inlet passes through the fixed end plate and the first discharge inlet does not pass through the fixed end plate, the first discharge inlet and the communication groove being formed as respective grooves in the inner surface of the fixed end plate, the communication groove having a concave groove shape.

2. The scroll compressor of claim 1, wherein the fixed end plate of the fixed scroll includes the discharge outlet at a position overlapping with any one of the first discharge inlet or the second discharge inlet.

3. The scroll compressor of claim 2, wherein the discharge outlet has a circular or elliptical shape.

4. A scroll compressor, comprising:

a casing;

a drive motor provided in an inner space of the casing;

a main frame provided adjacent to the drive motor and fixed in the inner space of the casing;

a fixed scroll provided adjacent to the main frame and including a fixed end plate having an inner surface and an outer surface and a discharge outlet is disposed on the outer surface;

an orbiting scroll provided between the main frame and the fixed scroll and engaged with the fixed scroll to perform an orbiting movement to form first and second compression chambers with the fixed scroll; and a rotary shaft coupled to the drive motor and including a main bearing portion supported by the main frame, a sub bearing portion supported by the fixed scroll, and an eccentric portion eccentrically coupled to the orbiting scroll, the fixed end plate of the fixed scroll includes a first discharge inlet configured to discharge a refrigerant compressed in the first compression chamber, a second discharge inlet configured to discharge a refrigerant compressed in the second compression chamber, and a communication groove that provides selective communication between the first discharge inlet and the second discharge inlet and a common outlet or respective outlets based on a position of the orbiting wrap, wherein the second discharge inlet passes through the fixed end plate and the first discharge inlet does not pass through the fixed end plate, the first discharge inlet and the communication groove being formed as respective grooves in the inner surface of the fixed end plate, the communication groove having a concave groove shape.

5. The scroll compressor of claim 4, wherein the fixed end plate of the fixed scroll includes the common discharge outlet at a position overlapping with any one of the first discharge inlet or the second discharge inlet.

6. The scroll compressor of claim 5, wherein the common discharge outlet has a circular or elliptical shape.

* * * * *